US010541492B2

(12) United States Patent
Bar-Hai et al.

(10) Patent No.: US 10,541,492 B2
(45) Date of Patent: Jan. 21, 2020

(54) CONNECTOR FOR WITHSTANDING HIGH PRESSURE

(71) Applicant: ZEVULUN MARINE SYSTEMS LTD., Kfar Adumim (IL)

(72) Inventors: Moshe Bar-Hai, Rehovot (IL); Eliav Bar-Hai, Moshav Avnei Eitan (IL)

(73) Assignee: ZEVULUN MARINE SYSTEMS LTD., Kfar Adumin (IL)

( * ) Notice: Subject to any disclaimer, the term of this patent is extended or adjusted under 35 U.S.C. 154(b) by 0 days.

(21) Appl. No.: 15/757,848

(22) PCT Filed: Mar. 9, 2017

(86) PCT No.: PCT/IL2017/050300
§ 371 (c)(1),
(2) Date: Mar. 6, 2018

(87) PCT Pub. No.: WO2017/154000
PCT Pub. Date: Sep. 14, 2017

(65) Prior Publication Data

US 2018/0342832 A1 Nov. 29, 2018

Related U.S. Application Data

(60) Provisional application No. 62/306,193, filed on Mar. 10, 2016.

(51) Int. Cl.
*H01R 13/533* (2006.01)
*H01R 13/52* (2006.01)
(Continued)

(52) U.S. Cl.
CPC ..... *H01R 13/533* (2013.01); *H01R 9/11* (2013.01); *H01R 13/508* (2013.01);
(Continued)

(58) Field of Classification Search
CPC ..... H01R 13/5205; H01R 13/533; H01R 13/5025; H01R 13/521; H01R 13/6691; H01R 43/20
See application file for complete search history.

(56) References Cited

U.S. PATENT DOCUMENTS 3,264,602 A * 8/1966 Schwartz ..... H01R 9/0521 174/89
3,686,623 A * 8/1972 Nijman ..... H01R 4/52 439/581
(Continued)

FOREIGN PATENT DOCUMENTS

CN 203481509 U 3/2014
KR 101399070 B1 5/2015

OTHER PUBLICATIONS

International Patent Application No. PCT/IL2017/050300, International Search Report dated Jul. 4, 2017.
(Continued)

*Primary Examiner* — Briggitte R. Hammond
(74) *Attorney, Agent, or Firm* — Novick, Kim & Lee, PLLC; Jae Youn Kim

(57) ABSTRACT

A cable connector including a connector shell including a support and an insert, wherein the insert includes a surface inclined to a cable-to-face direction of the insert so as to re-direct force applied on a face side of the insert sideways toward sides of the connector shell, and the support includes a surface inclined to the cable-to-face direction of the connector shell so as to react to the force, pushing back on the insert, thereby exerting a compression force on the insert. Related apparatus and methods are also described.

19 Claims, 21 Drawing Sheets

(51) Int. Cl.

| | |
|---|---|
| ***H01R 13/508*** | (2006.01) |
| ***H01R 43/20*** | (2006.01) |
| ***H01R 13/66*** | (2006.01) |
| ***H01R 13/502*** | (2006.01) |
| ***H01R 9/11*** | (2006.01) |

(52) U.S. Cl.
CPC ..... *H01R 13/5025* (2013.01); *H01R 13/521* (2013.01); *H01R 13/5219* (2013.01); *H01R 13/6691* (2013.01); *H01R 43/20* (2013.01)

(56) References Cited

U.S. PATENT DOCUMENTS 3,963,321 A * 6/1976 Burger ..... H01R 9/0503 439/584
3,985,418 A * 10/1976 Spinner ..... H01R 9/05 439/584
4,039,242 A 8/1977 Wilson et al.
4,156,554 A * 5/1979 Aujla ..... H01R 9/05 174/89
4,174,875 A 11/1979 Wilson et al.
4,241,973 A * 12/1980 Mayer ..... H01R 24/40 174/73.1
4,606,603 A 8/1986 Cairns
4,682,848 A 7/1987 Cairns et al.
4,801,277 A 1/1989 Seilhan
5,997,350 A * 12/1999 Burris ..... H01R 9/0521 285/249
6,361,348 B1 * 3/2002 Hall ..... H01R 13/6277 439/352
7,140,645 B2 * 11/2006 Cronley ..... F16L 37/1215 285/34
7,878,832 B2 2/2011 Hui
8,585,423 B2 11/2013 Marklove et al.
10,033,169 B2 * 7/2018 Umemoto ..... H02G 1/14
2006/0105628 A1 * 5/2006 Montena ..... H01R 9/0524 439/578
2006/0134979 A1 6/2006 Henningsen
2013/0011102 A1 1/2013 Rinzler et al.
2013/0030989 A1 1/2013 Geller et al.
2013/0337682 A1 * 12/2013 Paulus ..... H01R 9/05 439/578
2015/0010496 A1 1/2015 Cerundolo et al.
2018/0175520 A1 * 6/2018 Wu ..... H01R 9/0527

OTHER PUBLICATIONS

International Patent Application No. PCT/IL2017/050300, Written Opinion dated Jul. 4, 2017.
"M Series" connector, undated product data sheet, pp. 241 through 250, 10 pages.
"Subsea Connectors, Burton, Electro Oceanic, Solutions You Can Trust in Challenging Conditions", Cooper Interconnect, www.cooperinterconnect.com, 2012, 60 pages.
"MINI-CON / Micro MINI CON Underwater Electrical Dry-Mat Connectors", Seacon, www.seaconworldwide.com, Rev XI, 2015, 28 pages.
"BIRNS Millennium Connector Series Brochure Rev. B", Birns High Performance Under Pressure, www.birns.com, 2016, 18 pages.
"Connectors for Oil & Gas Marks", undated marketing brochure, www.amphenol-oilgas.com, 8 pages.
"HydroVolt: Underwater Electrical Connectors", undated marketing brochure, AK Industries, www.ak-ind.com, 9 sheets.
"High Performance Underwater Electrical Connectors", Gisma Series Feb. 10, 2014, 18 pages.

* cited by examiner

CONNECTOR FOR WITHSTANDING HIGH PRESSURE

RELATED APPLICATIONS

This application is a national phase entry of International Patent Application No. PCT/IL2017/050300, filed Mar. 9, 2017, which claims the benefit under 35 U.S.C. § 119(b) to U.S. Patent Application Ser. No. 62/306,193, filed Mar. 10, 2016; the entire contents of which are hereby incorporated by reference.

FIELD AND BACKGROUND OF THE INVENTION

The present invention, in some embodiments thereof, relates to a connector for withstanding high pressure and to methods for manufacturing such a connector, and, more particularly, but not exclusively, to a connector for use underwater.

The term "connector" is used in the present specification and claims to mean a "connector for withstanding high pressure".

The term "electric connector" is used in the present specification and claims to mean an "electric connector for withstanding high pressure".

Background art includes:

U.S. Pat. No. 8,585,423;

U.S. Patent Application Publication Number 2015/104964;

U.S. Patent Application Publication Number 2013/309896.

U.S. Pat. No. 7,878,832;

U.S. Pat. No. 4,801,277;

CN Patent Publication Number 203481509; and

KR Patent Publication Number 101399070;

The disclosures of all references mentioned above and throughout the present specification, as well as the disclosures of all references mentioned in those references, are hereby incorporated herein by reference.

SUMMARY OF THE INVENTION

A connector for withstanding high pressure can be produced of a rigid shell and an insert. The rigid shell is usually shaped to connect to another shell of a mating connector, forming a mechanical connection, and the insert typically includes electric conductors for electric connection to corresponding electric conductors in the mating connector.

In a connector that is under high pressure, the insert is also under high pressure, and is pushed backed, by the high pressure, into the connector. The force acting on the insert produces shear forces in the connector, which may potentially distort the insert and/or potentially produce cracks in the insert. Distortion and/or cracks potentially allows water and/or dirt into the insert, potentially compromising the electric connection, potentially causing shorts or electric signal degradation, potentially compromising structural and/or electric integrity of the connection.

An aspect of some embodiments of the present invention includes shaping a connector shell and an insert so that when a face of the insert is under pressure, the force of the pressure is directed against the connector shell in a direction which reduces shear, and potentially compresses the insert onto electric connectors, enhancing structural and/or electric integrity of the connection instead of compromising the structural and/or electric integrity of the connection.

According to an aspect of some embodiments of the present invention there is provided a cable connector including a connector shell including a support and an insert, wherein the insert includes a surface inclined to a cable-to-face direction of the insert so as to re-direct force applied on a face side of the insert sideways toward sides of the connector shell, and the support includes a surface inclined to the cable-to-face direction of the connector shell so as to react to the force, pushing back on the insert, thereby exerting a compression force on the insert.

According to some embodiments of the invention, the insert includes a surface inclined at an angle θ to a cable-to-face direction of the insert, and the support includes a first, inner, surface inclined at a same angle θ to the cable-to-face direction of the insert, such that when the insert is within the support the inclined surface of the insert and the first, inner, inclined surface of the support are adjacent to each other.

According to some embodiments of the invention, the support is a separate component from the connector shell.

According to some embodiments of the invention, the support further includes a second, outer surface at an angle parallel to an inner surface of the connector shell, such that when the support is within the connector shell the second, outer, surface of the support is adjacent to an inner surface of the connector shell.

According to some embodiments of the invention, an outer diameter of the insert and an outer diameter of the support are sized so as to pass through a back opening in the connector shell, to enable assembly of the connector by inserting the insert and the support through the back opening in the connector shell.

According to some embodiments of the invention, the insert includes an inner passage shaped for containing an electric conductor, wherein the inner passage is sized and shaped to seal the inner passage when the electric conductor is contained within the passage.

According to some embodiments of the invention, further including a sealing gasket on a front face of the connector, the sealing gasket including a protruding portion for wrapping a portion of a protruding electric contact.

According to some embodiments of the invention, further including a sealing gasket on a front face of the connector, the sealing gasket including a recess for accepting a protruding portion of a gasket when mated to a mating connector.

According to some embodiments of the invention, the insert includes an inner passage shaped for containing an optic signal to electric signal converter, wherein the inner passage is sized and shaped to conform to an external shape of the converter.

According to some embodiments of the invention, the support includes a plurality of rings with an outer diameter equal to an inner diameter of the connector shell.

According to some embodiments of the invention, the support includes a span between the rings with an outer diameter smaller than an inner diameter of the connector shell. According to some embodiments of the invention, the support includes a spring. In some embodiments, the support can be made from elastic materials instead of or in addition to including a spring. In some embodiments the support comprises one or more elastic materials. The support can be patially or entirely made from one or more elastic materials.

According to some embodiments of the invention, the support includes a slot in an axial direction, from a front edge of the support toward a back edge of the support.

According to some embodiments of the invention, the support includes a plurality of slots.

According to some embodiments of the invention, the support includes a plurality of sections shaped to fit together and make up the support. According to some embodiments of the invention, the support includes two sections shaped to fit together and make up the support.

According to some embodiments of the invention, further including a retainer shaped to attach to a back edge of the connector shell, preventing the support and the insert from exiting the back of the connector shell.

According to some embodiments of the invention, the support is shaped to attach to a back edge of the connector shell, preventing the insert from exiting the back of the connector shell.

According to an aspect of some embodiments of the present invention there is provided a method of manufacturing a connector including providing a connector shell, providing an insert, providing a support, inserting the insert into the connector shell through a back opening in the connector shell, and inserting the support into the connector shell through a back opening in the connector shell, wherein the insert includes a surface inclined to a cable-to-face direction of the insert so as to re-direct force applied on a face side of the insert sideways toward sides of the connector shell, and the support includes a surface inclined to the cable-to-face direction of the connector shell so as to react to the force, pushing back on the insert, thereby exerting a compression force on the insert.

According to some embodiments of the invention, the insert includes a surface inclined to a cable-to-face direction of the insert so as to re-direct force applied on a face side of the insert sideways toward sides of the connector shell, and the support includes a surface inclined to the cable-to-face direction of the connector shell so as to react to the force, pushing back on the insert, thereby exerting a compression force on the insert.

According to an aspect of some embodiments of the present invention there is provided a kit including a connector insert, and an insert support, wherein the connector insert includes a surface inclined at an angle θ to a cable-to-face direction of the connector insert, and the insert support includes an inner surface inclined at a same angle θ to the cable-to-face direction of the connector insert, such that when the connector insert is within the insert support the inclined surface of the insert support and the inner inclined surface of the insert support are parallel to each other.

According to some embodiments of the invention, further including a connector shell, and wherein the connector shell includes at least a portion of an inner surface shaped and sized to mate with at least a portion of an outer surface of the insert support, such that when the insert support is within the connector shell the portion of the outer surface of the insert support is parallel to and touching the at least a portion of the inner surface of the connector shell.

According to an aspect of some embodiments of the present invention there is provided a kit including a connector shell, and a support including an inner surface inclined at an angle θ to a cable-to-face direction of the support, and an outer surface at an angle parallel to an inner surface of the connector shell, such that when the support is within the connector shell the outer surface of the support is parallel to and touching an inner surface of the connector shell.

According to some embodiments of the invention, further including a connector insert, and wherein the connector insert includes an outer surface inclined at an angle θ to a cable-to-face direction of the connector insert, and the connector insert is shaped and sized such that such that when the connector insert is within the support and the support is within the connector shell the inclined surface of the connector insert and the inner inclined surface of the support are parallel to each other.

According to an aspect of some embodiments of the present invention there is provided a method of providing a connector for withstanding high pressure, including providing a cable connector including a connector shell including a support and an insert, wherein the insert includes a surface inclined to a cable-to-face direction of the insert so as to re-direct force applied on a face side of the insert sideways toward sides of the connector shell, and the support includes a surface inclined to the cable-to-face direction of the connector shell so as to react to the force push back on the sideways force, thereby exerting a compression force on the insert.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
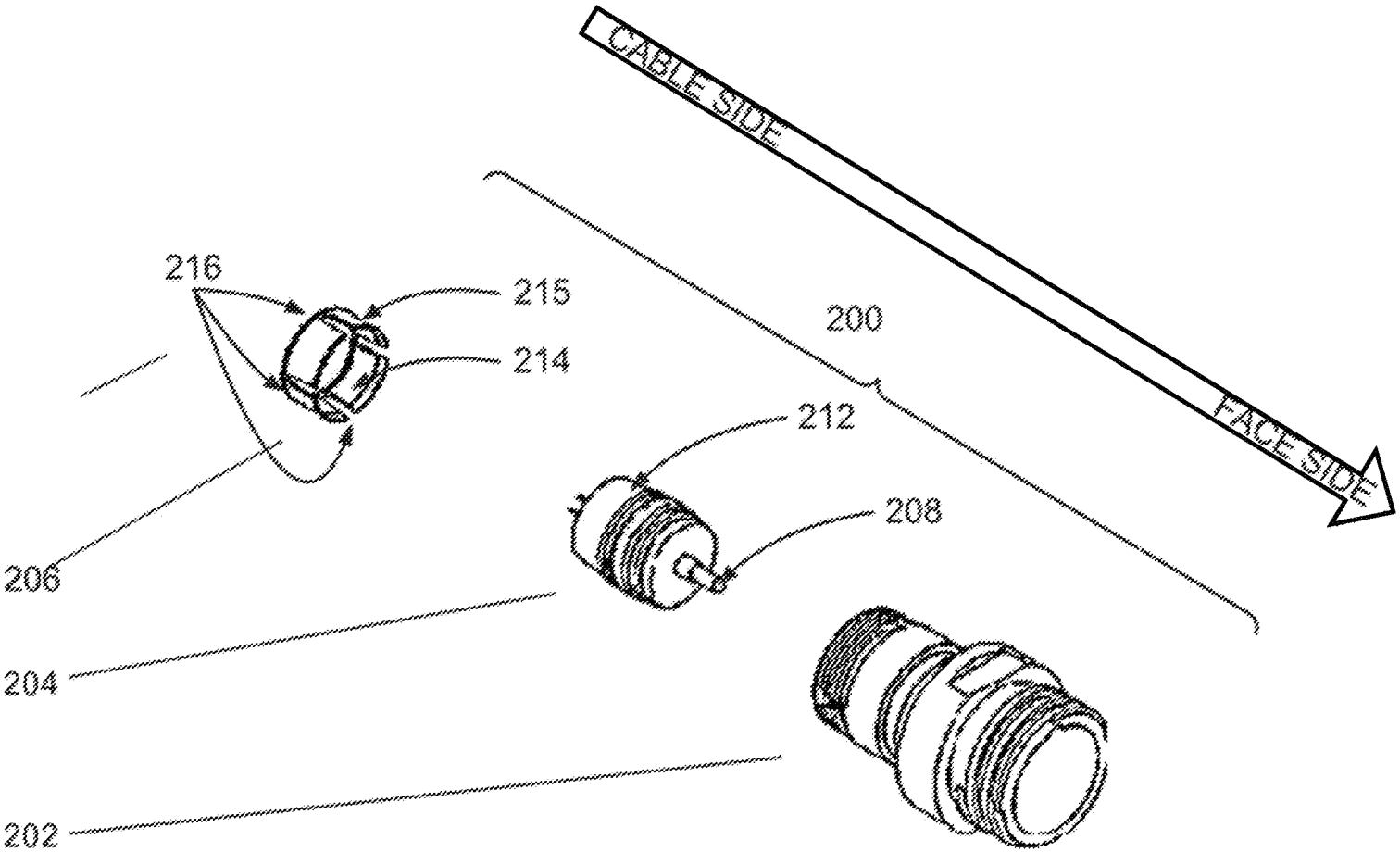
FIG. 1 is a simplified isometric illustration of an electric connector according to an example embodiment of the invention.

The present invention, in some embodiments thereof, relates to a connector for withstanding high pressure and to methods for manufacturing such a connector, and, more particularly, but not exclusively, to an electric connector for use underwater.

A Design for Using Pressure to Reduce Shear and/or to Compress

An aspect of some embodiments of the present invention includes shaping a connector shell and an insert so that when a face of the insert is under pressure, the force of the pressure is directed against the connector shell in a direction which reduces shear force on the insert, and potentially compresses the insert onto the electric connectors, enhancing structural and/or electric integrity of the connection instead of compromising the structural and/or electric integrity of the connection.

Providing the Design as a Separate Component, Potentially as an Add-on Component An aspect of some embodiments of the present invention includes providing a support for inserting into a connector shell so that when a face of the insert is under pressure, the force of the pressure is directed against the support, and the support against the connector shell, in a direction which reduces shear force on the insert, and potentially compresses the insert onto the electric connectors, potentially enhancing structural and/or electric integrity of the connection.

In some embodiments, the support includes an inclined inner surface, parallel to an inclined outer surface of the insert, such that when a face of the insert is under pressure, a force pushes the insert into the connector shell, against the inclined inner surface of the support. An angle of the incline redirects the force against walls of the support, and a reactive force back into the insert compresses the insert instead of shearing the insert, thereby improving the insert's ability to withstand pressure and resist tearing by shear forces.

Providing Components of the Design as a Kit

An aspect of some embodiments of the present invention includes providing a kit including some of the components described herein, to enable assembling an electric conductor onto a cable end. In some embodiments the kit may even enable transforming a standard connector shell into an electric connector according to an example embodiment of the invention.

Optionally Making the Support Springy

In some embodiments the support is designed to be springy when transferring force from the insert to the shell wall. In some embodiments the support has front and back outer rings for resting against the inner shell walls, and a span between the front and back rings is a small distance apart from the inner shell walls, to potentially flex under pressure. In some embodiments, the springy effect is achieved by making the entire support or a portion of the support from elastic material or materials (elastomers).

Examples of elastomers that can be used include but are not limited to:

(1 Unsaturated rubbers, such as natural and synthetic polyisoprene, polybutadiene, chloroprene rubber (polychloroprene, neoprene, baypren), butyl rubber (copolymer of isobutylene and isoprene), halogenated butyl rubbers (chloro butyl rubber, bromo butyl rubber), styrene-butadiene rubber (copolymer of styrene and butadiene), nitrile rubber (copolymer of butadiene and acrylonitrile), and hydrogenated nitrile rubbers;

(2 Saturated rubbers, such as ethylene propylene rubber (a copolymer of ethylene and propylene) and ethylene propylene diene rubber (a terpolymer of ethylene, propylene and a diene-component), epichlorohydrin rubber, polyacrylic rubber, silicone rubber, fluorosilicone rubber, fluoroelastomers, perfluoroelastomers, polyether block amides, chlorosulfonated polyethylene and ethylene-vinyl acetate;

(3 Epoxy resins;

(4 Polyoxymethylene;

(5 Thermoplastic elastomers, such as thermoplastic polyurethanes, thermoplastic olefins, styrenic block copolymers, thermoplastic copolyesters, thermoplastic polyamides;

(6 Proteins resilin and elastin;

(7 Polysulfide rubber;

(8 Elastolefin;

(9 Polyuretane;

(10 Polyamides and polyimides, such as kapton and vespel;

11) Polyether ether ketone (PEEK) and polyaryletherketone (PAEK) or any combination thereof.

In some embodiments, the above elastomers are used with carbon fiber reinforcement.

In some embodiments, the above elastomers are used without carbon fiber reinforcement.

In some embodiments, the above elastomers are used with glass reinforcement.

In some embodiments, the above elastomers are used without glass reinforcement.

In some embodiments the support is designed to be springy when enveloping the insert, optionally including slits along an axial direction so that the insert may expand the support and potentially flex under pressure.

Optionally Making the Design Suitable for Assembly from a Cable Side of the Connector An aspect of some embodiments of the present invention includes providing a method for assembling an insert and a support into a connector shell from a cable side of the connector shell.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Reference is now made to FIG. 1, which is a simplified isometric illustration of an electric connector 200 according to an example embodiment of the invention.

FIG. 1 depicts an exploded view of a few basic components of the electric connector 200, and depicts a specific design that potentially improves performance of the connector 200 when under pressure.

The electric connector 200 includes a shell 202; an insert 204; and a support 206. The insert 204 includes a surface 212 inclined at an angle to a cable-to-face direction of the insert 204; and the support 206 includes a first, inner, surface 214 inclined at a same angle to the cable-to-face direction of the support 206, so that the inner surface 214 of the support 206 is parallel to the surface 212 of the insert 204, and a second, outer surface 215 parallel to an inner surface of the shell 202.

In some embodiments the surface 212 of the insert 204 forms a truncated cone shape, while the inner surface 214 of the insert 206 forms a corresponding socket shape conforming to the shape of the truncated cone.

In some embodiments, the support 206 optionally includes one or more slots 216, designed to provide the support 206 some flexibility. The example embodiment of FIG. 1 depicts four slots 216, however any number of slots such as 1, 2, 3, 4, 5, 6, 7, 8, 9, 10 and larger numbers up to 20, 30 and larger.

FIG. 1 depicts one electric conductor 208 in the insert 204; however any larger number of electric conductors such as 2, 3, 4, 5, 6, 7, 8, 9, 10 and larger numbers up to 20, 30 and larger may also be used. FIG. 1 depicts just one conductor in the interest of keeping the drawing simple.

FIG. 1 also illustrates that the components making up the example embodiment of FIG. 1 may be assembled into a connector shell from a cable side, or back side, toward a face side, or front side, of the connector shell. As will be described in further detail below, with reference to FIGS. 8A-C, one phase of assembling an electric connector includes taking electric conductor(s) already assembled into an insert, and assembling the conductor(s)-plus-insert combination into a shell.

Figure 2:
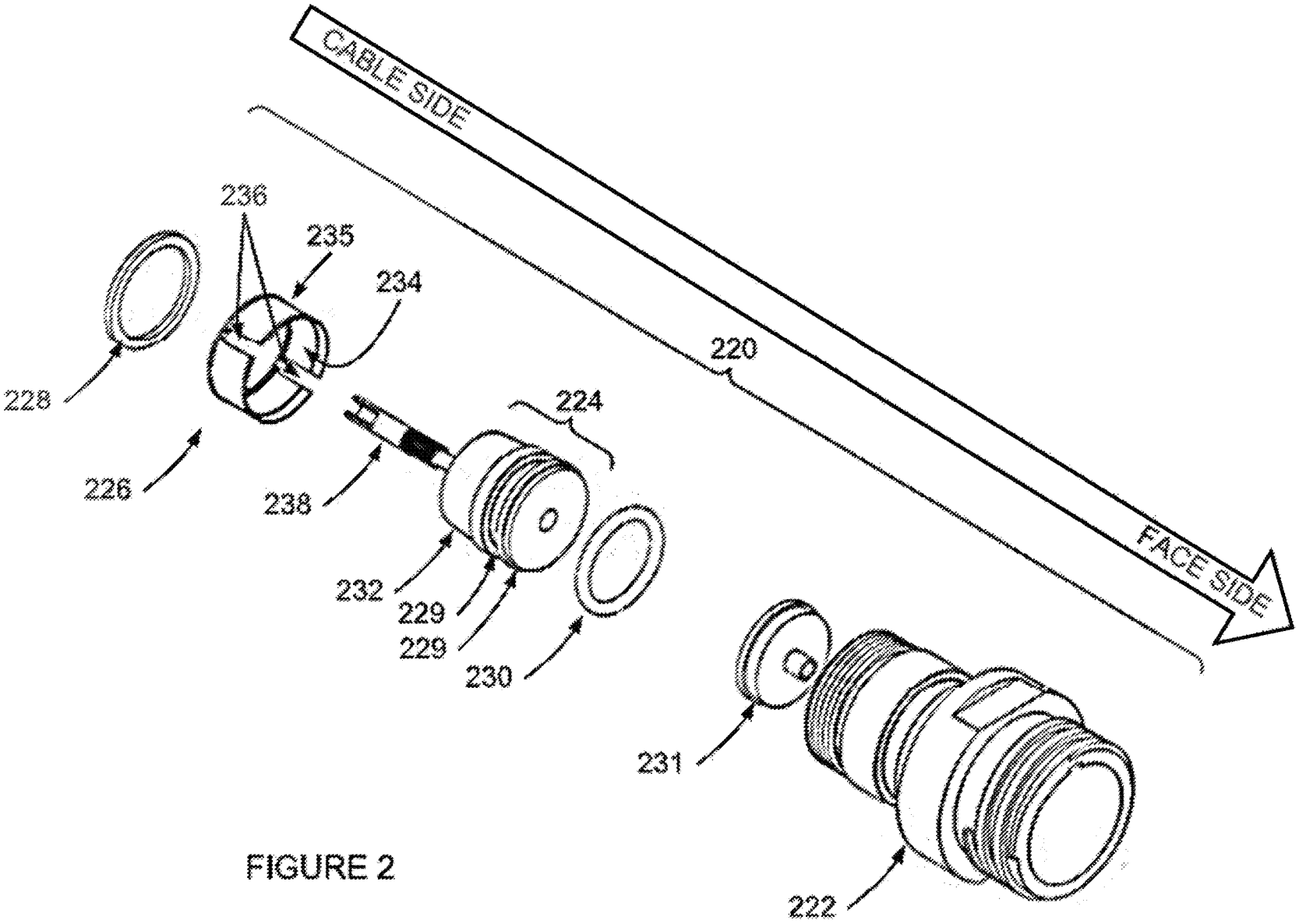
FIG. 2 is a simplified isometric illustration of an electric connector according to an example embodiment of the invention.

Reference is now made to FIG. 2, which is a simplified isometric illustration of an electric connector 220 according to an example embodiment of the invention.

FIG. 2 depicts an exploded view of more components of an electric connector 220 than depicted in FIG. 1, to show a design that potentially improves performance of the connector 220 when under pressure, but using more components, as are sometimes used in the art.

The electric connector 220 includes a shell 222; an insert 224; and a support 226. The insert 224 includes a surface 232 inclined at an angle to a cable-to-face direction of the insert; and the support 226 includes a first, inner, surface 234 inclined at a same angle to the cable-to-face direction of the support 226, and a second, outer surface 235 at an angle parallel to an inner surface of the shell 222.

In some embodiments, the support 226 optionally includes one or more slots 236, designed to provide the support 226 some flexibility. The example embodiment of FIG. 2 depicts 2 slots 226.

FIG. 2 depicts one electric conductor 238 for assembly into the insert 224. FIG. 2 depicts just one conductor 238 in the interest of keeping the drawing simple.

FIG. 2 also depicts an optional retainer 228. The retainer 228 potentially serves to prevent the support 226 and/or the insert 224 from being pushed back out of the shell 222 when a face of the insert 224 is under pressure.

In some embodiments the retainer 228 optionally connects to the shell 222 by threads (not shown) for screwing into the shell 222. In some embodiments the retainer 228 optionally connects to the shell 222 by protrusions (not shown) for mating with corresponding locking depressions (not shown) in the shell 222, potentially by pushing the retainer 228 into the shell 222. In some embodiments, the retainer 228 may be a C-clip, a spiral retainer ring, or a wave spring.

Some additional retaining methods include a C-clip, optionally inserted from a side slit, and/or pins entered from one or more side hole(s) so they sit behind the support 226. In some embodiments the support 226 may have a thread on its base and a matching thread in the shell 222.

In some embodiments the support 226 provides a function of retaining the insert in the shell, and the retainer 228 is not used in such embodiments. The support 226 may optionally be connected to the shell 222 by any one of the connection methods which were described above with reference to the retainer 228, or by other methods as are known in the art.

It is noted that under pressure on the face of the insert 224, the angle of the faces of the support 226 and the insert 224 are designed to divert force onto an inner surface of the shell 222, as will be described in more detail below, with reference to FIGS. 3D-3I.

The force acting on the insert 224 pushes it back, potentially expanding the support 226, which in turn deflects the force into a circumferential wall of the shell 222.

The force onto the inner surface of the shell 222 may also potentially increase friction between the insert 224 and the support 226 and the shell 222, which acts to reduce movement of the insert 224 backwards.

FIG. 2 also depicts one or more optional sealing gasket(s) 229, such as, for example, O-ring(s), around a circumference of the insert 224, for potentially sealing around the insert 224.

FIG. 2 also depicts an optional sealing ring 230, for potentially providing additional sealing a face of the insert 224.

FIG. 2 also depicts an optional sealing gasket 231, for potentially providing additional sealing a face of the shell 222. The sealing gasket 231 optionally includes a protrusion intended to wrap around the conductor 238. When the connector is connected to a mating connector, the protrusion enters a mating cavity, and fills up the space so that water and/or dirt are excluded, potentially providing improved electric insulation of the conductor 238 and/or improved connector mating in harsh environments.

FIG. 2 also illustrates that the components making up the example embodiment of FIG. 2 may be assembled into the connector shell 222 from a cable side, as described above with reference to FIG. 1.

Figure 3A:
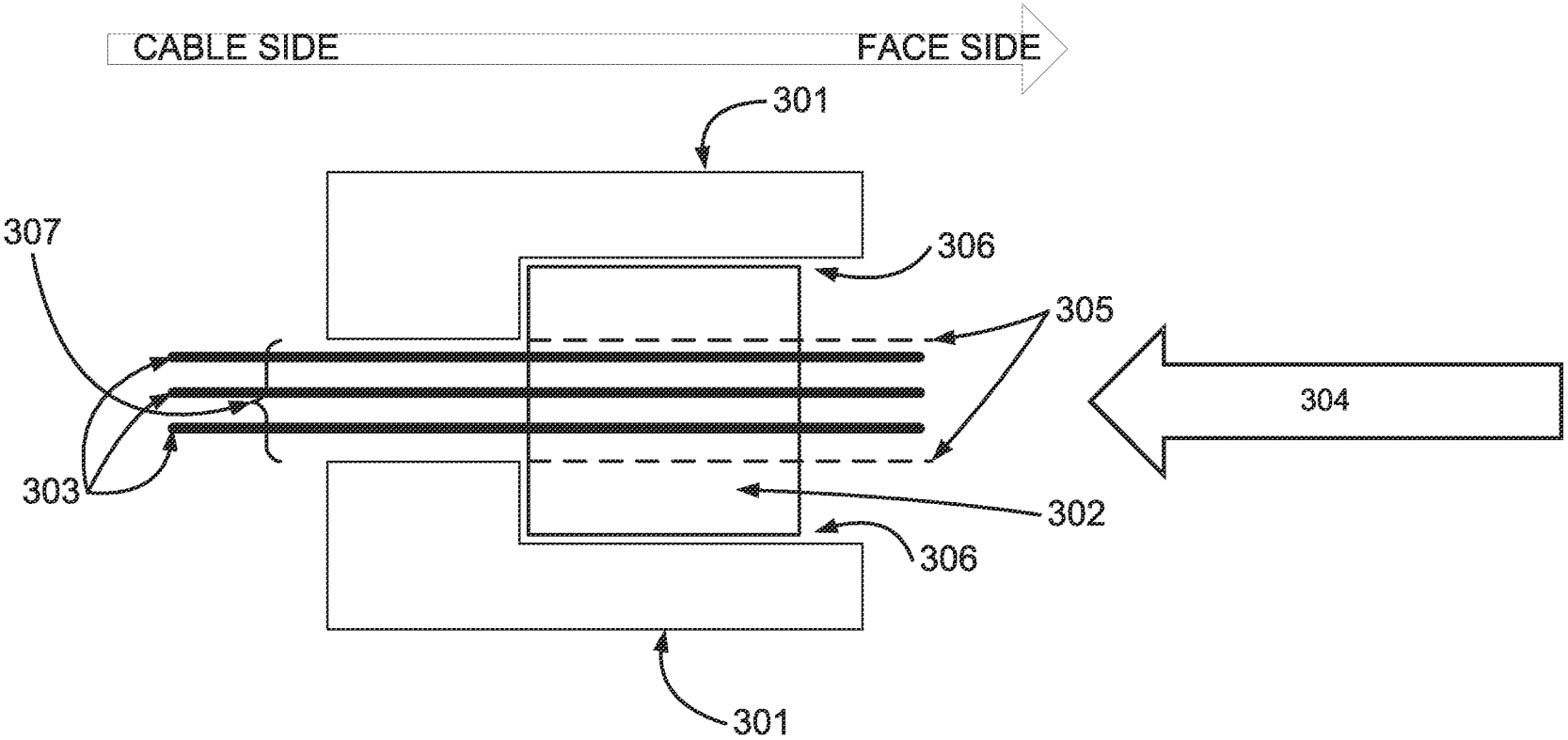
FIG. 3A is a simplified cross-sectional illustration of pressure acting on an insert and a shell in an electric connector that is not constructed according to an example embodiment of the invention.

Reference is now made to FIG. 3A, which is a simplified cross-sectional illustration of pressure acting on an insert and a shell in an electric connector that is not constructed according to an example embodiment of the invention.

FIG. 3A depicts a connector shell 301, and insert 302, and conductors 303 passing through the insert 302.

When pressure 304 acts on a face of the insert 302 and the shell 301, a hole 307 for passing the conductors 303 through the shell 301 does not provide support against a force produced by the pressure 304.

A shear force acts on the insert 302 along lines 305 approximately defined by a boundary of the hole 307. The shear force potentially negatively affects the insert 302.

Potentially, when the pressure persists over time, the insert 302 may weaken and may break.

Potentially, the pressure may cause the insert 302 to deform, and potentially peel away from contact with the shell 301 at a contact surface 306 between the insert 302 and the shell 301.

Figure 3B:
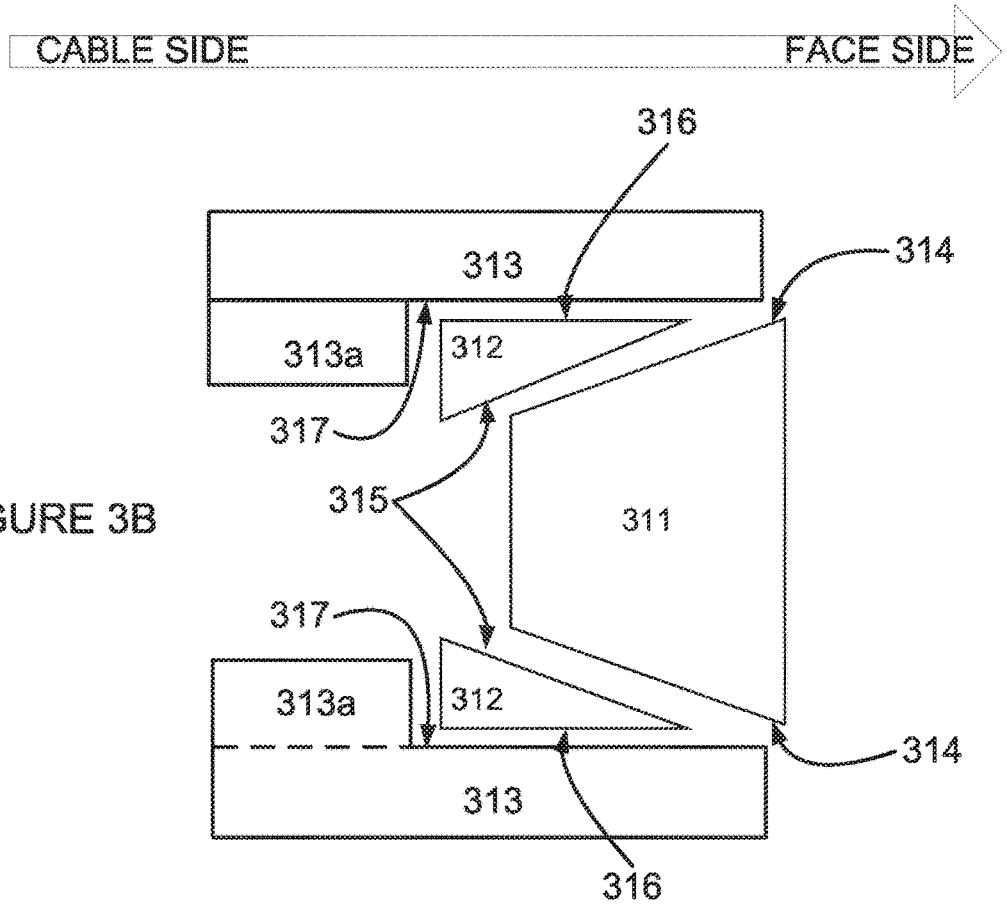
FIG. 3B is a simplified cross-sectional illustration of an electric connector constructed according to an example embodiment of the invention.

Reference is now made to FIG. 3B which is a simplified cross-sectional illustration of an electric connector constructed according to an example embodiment of the invention.

FIG. 3B illustrates some of the surfaces of an insert 311, a support 312 and a shell 313. FIG. 3B also depicts an optional retainer 313*a* for preventing the support 312 and the insert 311 from being pushed leftward out of the shell 313 by pressure (not shown) applied on a face of the insert 311 from the right.

The insert 311 includes a surface 314 inclined at an angle to a cable-to-face direction of the insert 311; and the support 312 includes a first, inner, surface 315 inclined at a same angle to the cable-to-face direction of the support 312, so that the inner surface 315 of the support 312 is parallel to the surface 314 of the insert 311, and a second, outer surface 316 parallel to an inner surface 317 of the shell 313.

In some embodiments the inner surface 315 of the support 312 is not necessarily parallel to the surface 314 of the insert 311, but the angle of the surfaces is designed to re-direct a pressure force acting left on the insert 311 to push back on the support 312. In some embodiments the surfaces may be, for example, conical, paraboloidal, or other such surfaces, while re-directing a pressure force acting left on the insert 311 to push back on the support 312.

In some embodiments the outer surface 316 of the support 312 is not necessarily parallel to the inner surface 317 of the shell 313, but the design of the support is to direct a force acting radially on the support 312 to push against the inner surface 317 of the shell 313.

In some embodiments the outer surface 316 of the support 312 is designed to exert friction on the inner surface 317 of the shell 313, so that when force is exerted on the insert 311 from right to left, the friction potentially diminishes a force on the optional retainer 313*a*.

Figure 3C:
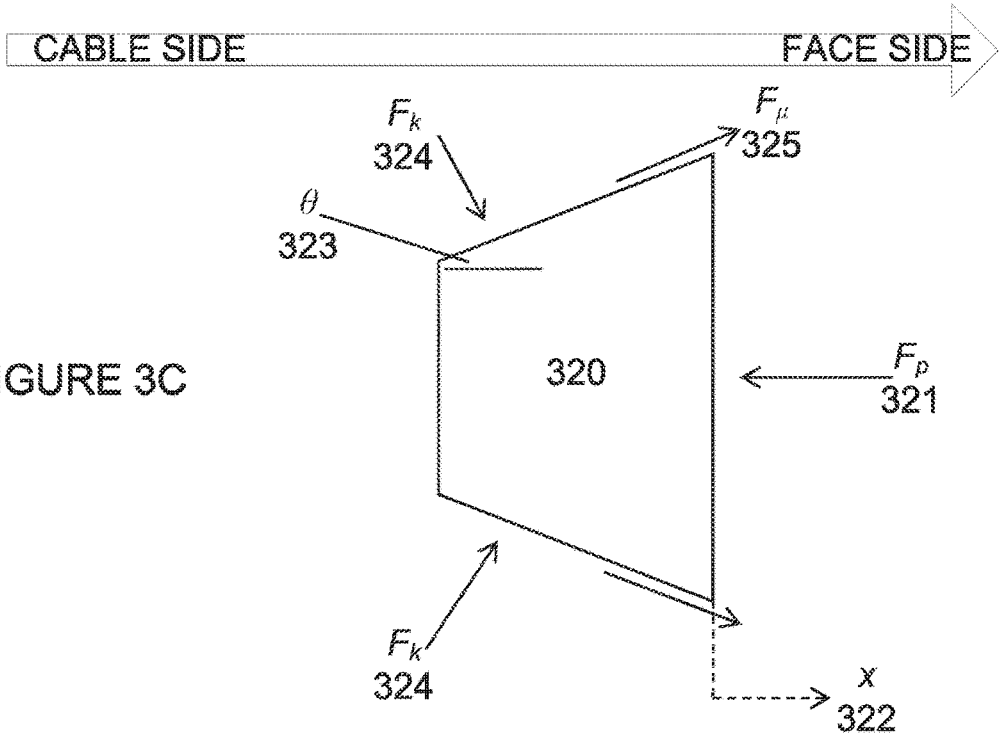
FIG. 3C is a simplified cross-sectional illustration of an insert 320 in an electric connector constructed according to an example embodiment of the invention.

Reference is now made to FIG. 3C which is a simplified cross-sectional illustration of an insert 320 in an electric connector constructed according to an example embodiment of the invention.

FIG. 3C depicts forces acting on the inset 320.

$F_p$ 321 is a force acting on a face of the insert as a result of pressure on the face of the insert. The force $F_p$ potentially causes a displacement x 322 of the insert relative to a support or relative to a connector shell. Small though x may be, x is a displacement caused by compression of the insert and/or by the insert sliding under the action of the force $F_p$.

θ 323 is an angle of the insert surface relative to a cable-to-face direction of the insert, as was mentioned above with reference to FIGS. 1, 2 and 3B.

μ is a coefficient of friction, for example between the insert and the support.

x is a variable describing a displacement of the insert under pressure, and $x_2$ is a final position after movement of the insert.

The following forces acting on the insert are depicted in FIG. 3C:

the force $F_p$ 321;

a spring force $F_k$ 324 which results from a support such as the support in FIGS. 1 and 2 pushing back on the insert 320; and a force $F_\mu$ 325 which is a friction force.

The force $F_k$ may be described as follows:

$$F_k=-k\cdot x\cdot\sin(\theta) \qquad \text{Equation 1}$$

Where k is a spring coefficient of, for example, the support.

The friction force $F_\mu$ may be described as follows:

$$F_\mu=F_k\cdot\mu=-k\cdot x\cdot\sin(\theta) \qquad \text{Equation 2}$$

At static equilibrium, when the insert is not moving, $x=-x_2$, the following Equation holds true:

$$F_p=F_k\sin(\theta)+F_\mu\cos(\theta) \qquad \text{Equation 3}$$

Substituting $F_k$ and $F_\mu$ and dividing by $F_k$:

$$F_p/F_k=\sin(\theta)+\mu\cos(\theta) \qquad \text{Equation 4}$$

Upper Bound for θ

A ratio $R_1=F_p/F_k$ is defined. In some embodiments an upper limit to the ratio R1 is used as follows:

$$\sin(\theta)+\mu\cos(\theta)<R_1 \qquad \text{Equation 5}$$

the angle θ is typically small, so the following approximation may be used when the angle is written using radian angle units:

$$\theta+\mu<R_1 \qquad \text{Equation 6}$$

A practical range for a friction coefficient μ is 0.05 to 0.5, and a good ratio for R1 would have Fk at least double Fp, so a good upper bound on the angle θ may be approximately:

$$\theta<0.5-\mu=0 \text{ to } 0.45 \text{ radians.}$$

Lower Bound for θ

The angle θ re-directs force from the insert sideways onto a support or onto connector shell walls. When the angle θ is small, the sideways force becomes large. In some embodiments the re-directed force $F_k \cos(\theta)$ is limited to be no more than a specific multiple of the pressure force $F_p$:

$$F_k \cos(\theta)/F_p < R_2 \quad \text{Equation 7}$$

Rearranging the above equation and then using Equation 4 from above:

$$\text{Cos}(\theta) < R_2 F_p / F_k = R_2(\sin\theta) + \mu\cos(\theta) \quad \text{Equation 8}$$

the angle θ is typically small, so the following approximation may be used when the angle is written using radian angle units:

$$1 < R_2(\theta + \mu) \quad \text{Equation 9}$$

Solving for θ:

$$1/R_2 - \mu < \theta \quad \text{Equation 10}$$

A practical range for a friction coefficient μ is 0.05 to 0.5. in some embodiments, 0.05 is a value used for μ and an acceptable ratio for R2 would be up to approximately 10, so a lower bound on the angle may be $$\theta > 0.05 \text{ radians}$$

In some embodiments the angle θ is optionally selected in a range between 0.05 to 0.4 radians.

Figure 3D:
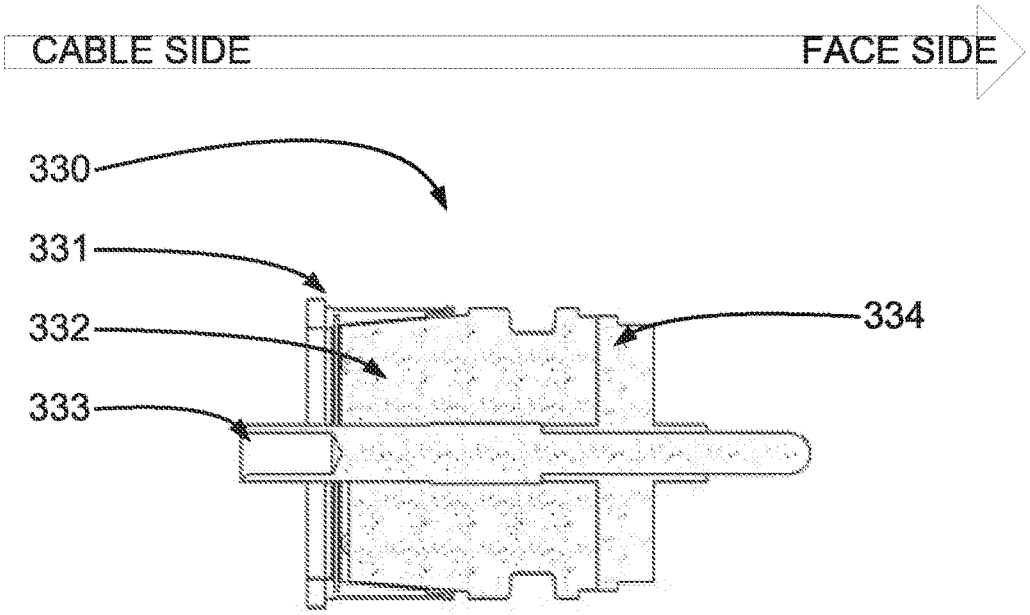
FIG. 3D is a simplified cross-sectional illustration of a model of components in an electric connector constructed according to an example embodiment of the invention to be used to model stress under pressure in the components of the electric connector.

Reference is now made to FIG. 3D, which is a simplified cross-sectional illustration of a model 330 of components in an electric connector constructed according to an example embodiment of the invention to be used to model stress under pressure in the components of the electric connector.

FIG. 3D depicts the following components: a support 331; an insert 332; a conductor 333; and a sealing gasket 334. The connector shell is not depicted in FIG. 3D—it provides support for the outer surface of the model, and in a finite element analysis is not considered as giving way of flexing under pressure.

Figure 3E:
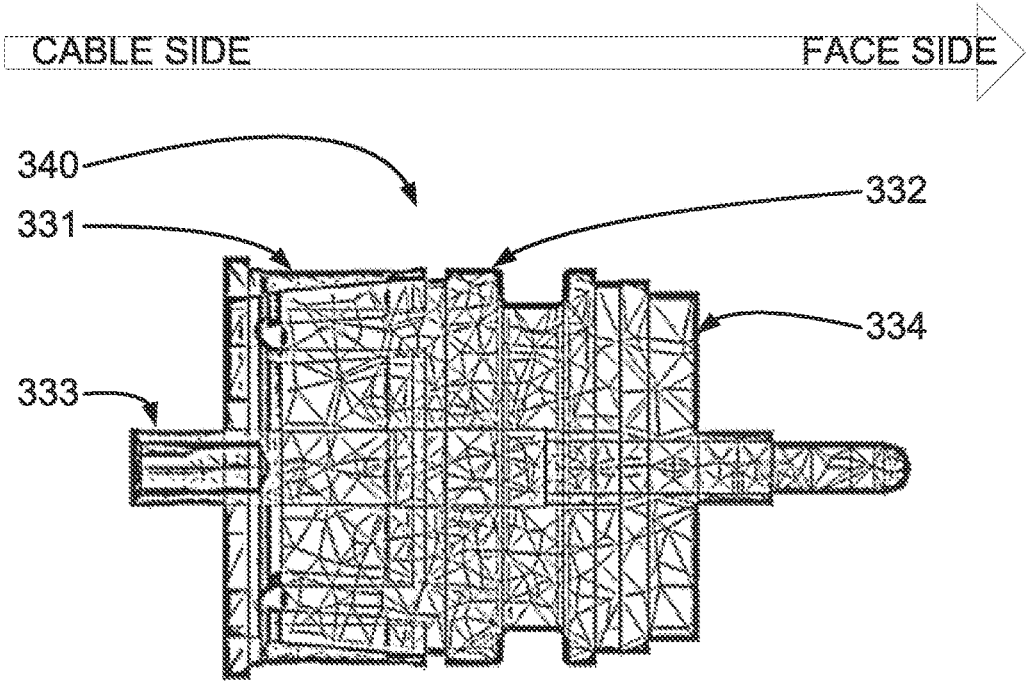
FIG. 3E is a simplified cross-sectional illustration of a finite element analysis mesh of the model of FIG. 3D.

Reference is now made to FIG. 3E, which is a simplified cross-sectional illustration of a finite element analysis mesh 340 of the model of FIG. 3D.

FIG. 3E depicts the following components: the support 331; the insert 332; the conductor 333; and the sealing gasket 334.

Figure 3F:
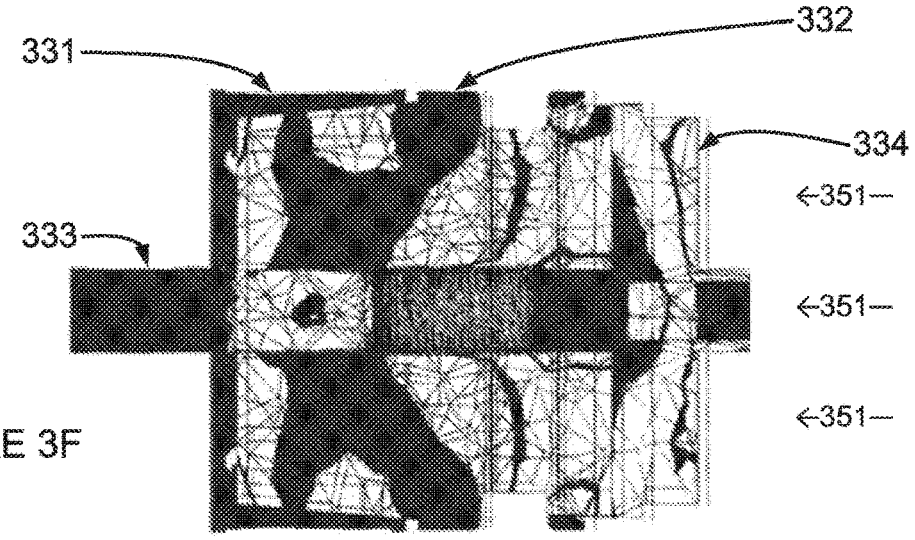
FIGS. 3F-H are simplified cross-sectional illustrations of the finite element analysis mesh of FIG. 3E under three levels of pressure.
Figure 3G:
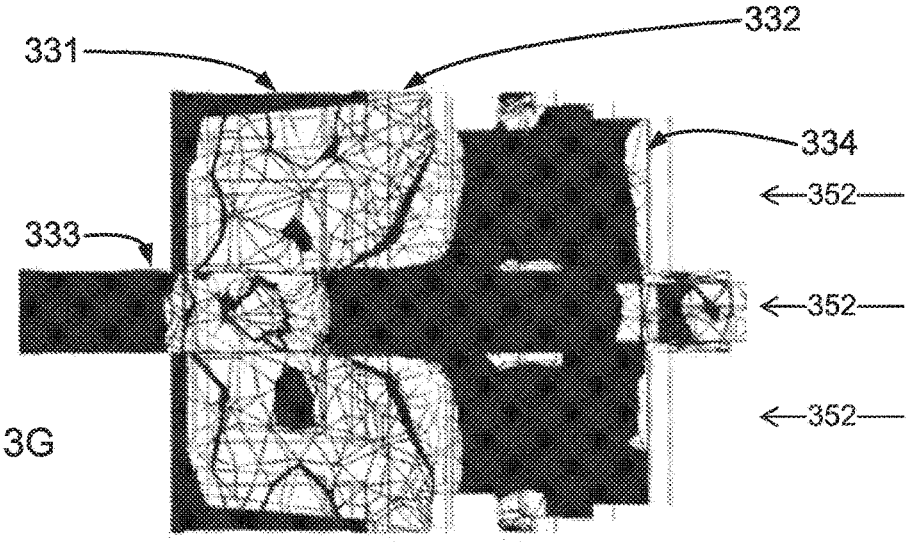
Figure 3H:
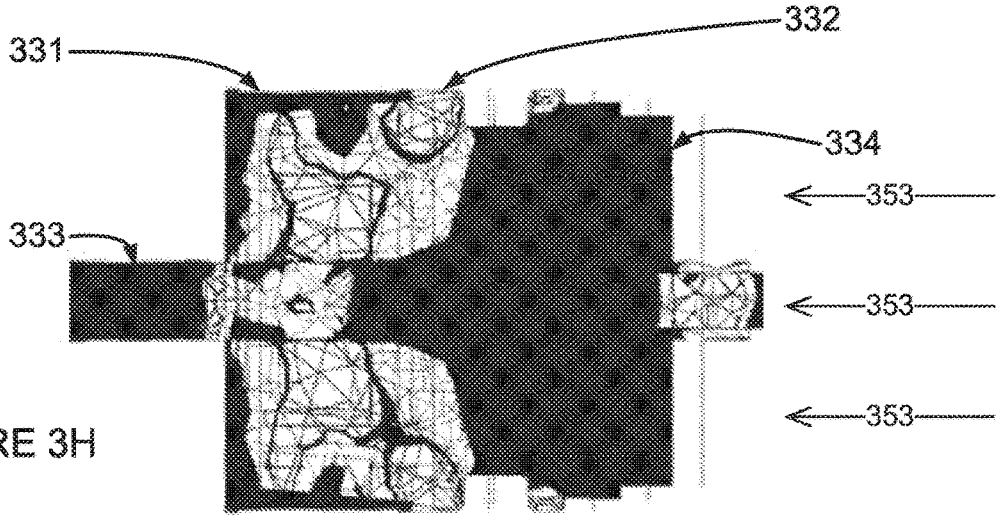

Reference is now made to FIGS. 3F-H, which are simplified cross-sectional illustrations of the finite element analysis mesh of FIG. 3E under three levels of pressure.

FIGS. 3F-H also depict the support 331, the insert 332, the conductor 333, and the sealing gasket 334.

FIG. 3F depicts the finite element analysis mesh under relatively small pressure 351 of up to 3,000 psi (~205 atmospheres). Dark areas in FIG. 3F depict where stress is higher. The pressure 351 is relatively small, and some of the relatively small stress is in the insert 332. FIG. 3F depicts the relative distribution of stress, and the stress in the insert 332 is only partially countered by the reaction forces, yet still not structurally critical.

FIG. 3G depicts the finite element analysis mesh under medium levels of pressure 352 of 3,000-7,000 psi (~205-476 atmospheres). Dark areas in FIG. 3G depict where stress is higher. Stress in the insert 332 is now more evenly distributed due to the support pushing against the insert 332. It is apparent that there are no special concentrations of stress, which imply shear forces acting on the insert. It is also seen that the reaction forces from the support 331 shifts stress into a front part of the insert 332, creating a stress blockade which negates the shear effects and in turn grants structural endurance to the insert 332.

FIG. 3H depicts the finite element analysis mesh under still higher levels of pressure 353 of 7,000-10,000 psi (~476-680 atmospheres). Dark areas in FIG. 3H depict where stress is higher. It is apparent that stress in the insert 332 is still approximately evenly distributed due to the support pushing against the insert 332. It is apparent that there are no special concentrations of stress, which imply shear forces acting on the insert.

Figure 3I:
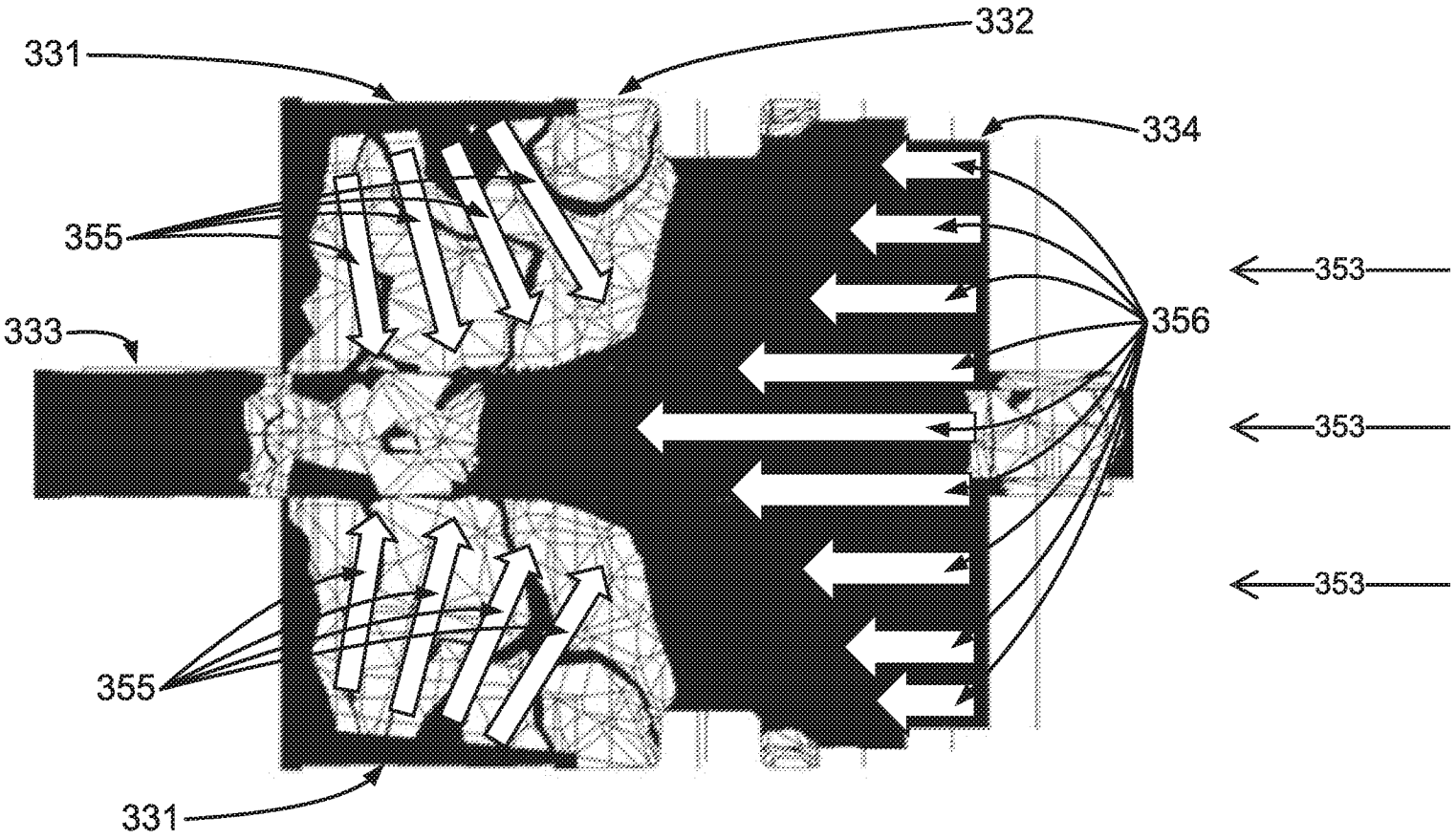
FIG. 3I is a simplified cross-sectional illustration of the finite element analysis mesh of the model of FIG. 3H and of forces acting in the model and of displacements of elements of the model.

Reference is now made to FIG. 3I, which is a simplified cross-sectional illustration of the finite element analysis mesh of the model of FIG. 3H and of forces acting in the model and of displacements of elements of the model.

FIG. 3I also depict the support 331, the insert 332, the conductor 333, and the sealing gasket 334.

FIG. 3I depicts forces 355 from the support 331 as a reaction to pressure 353 of the insert 332. The reaction forces balance the pressure 353 forces exerted by the insert 332.

FIG. 3I also depicts relative displacement 356 of the sealing gasket 334 and the insert 332 as a reaction to the pressure 353. The relative displacement is much exaggerated in FIG. 3I, and illustrates that that is greater displacement at a center of the support 332 than at the sides of the support 332. It is noted that the sealing gasket 334 may be flexible, as the sealing gasket 334 is prevented from spreading to the sides by the shell (not shown).

Figure 4A:
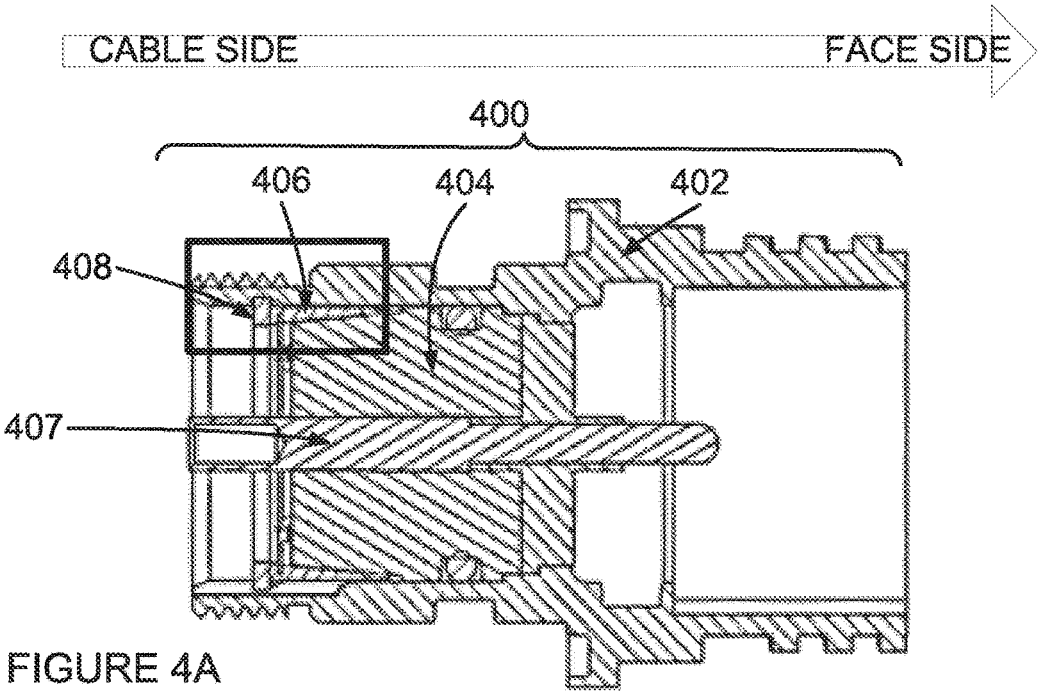
FIG. 4A is a simplified cross-sectional illustration of an electric connector according to an example embodiment of the invention.

Reference is now made to FIG. 4A, which is a simplified cross-sectional illustration of an electric connector 400 according to an example embodiment of the invention.

Figure 4B:
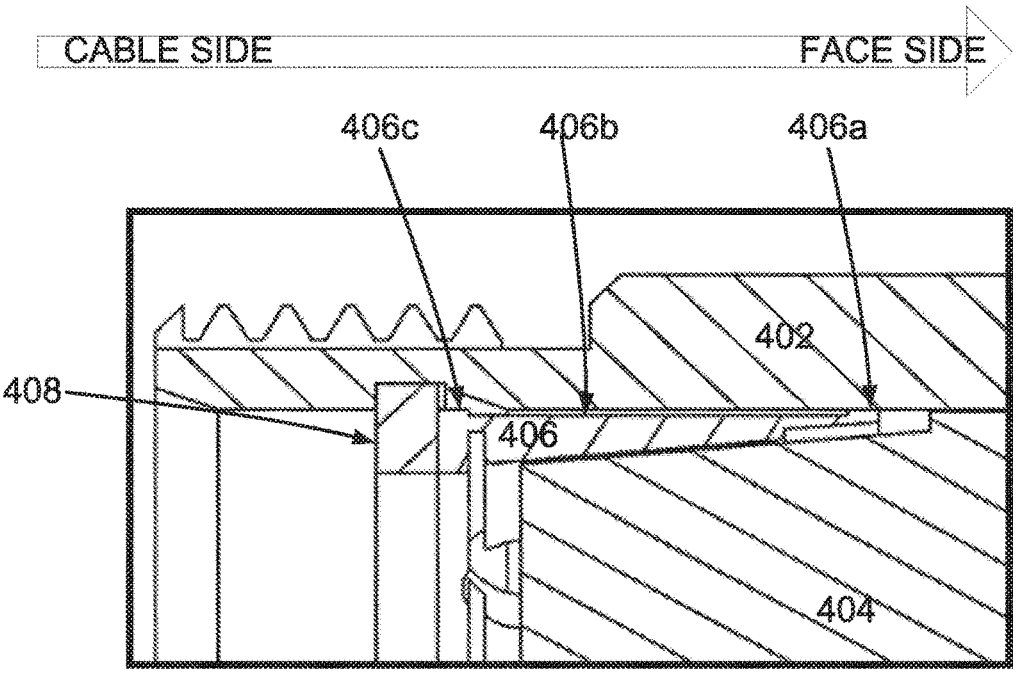
FIG. 4B is a simplified cross-sectional illustration of an enlarged portion of the example embodiment of FIG. 4A.

Reference is additionally made to FIG. 4B, which is a simplified cross-sectional illustration of an enlarged portion of the example embodiment of FIG. 4A.

FIGS. 4A and 4B depict a cross-sectional view of the electric connector 400, including a shell 402; an insert 404; a support 406; one or more conductor(s) 407; and an optional retainer 408.

FIG. 4B depicts an enlarged portion of FIG. 4A, and attention is drawn to three portions of the support 406. A face side portion 406*a*, a mid-portion 406*b*, and a cable side portion 406*c*. The face side portion 406*a* and the cable side portion 406*c* protrude from the support 406 towards inner walls of the connector shell 402, and potentially act as fulcrums for support 406 to potentially flex under pressure, and potentially provide the force $F_k$ 324 depicted in FIG. 3C.

Figure 4C:
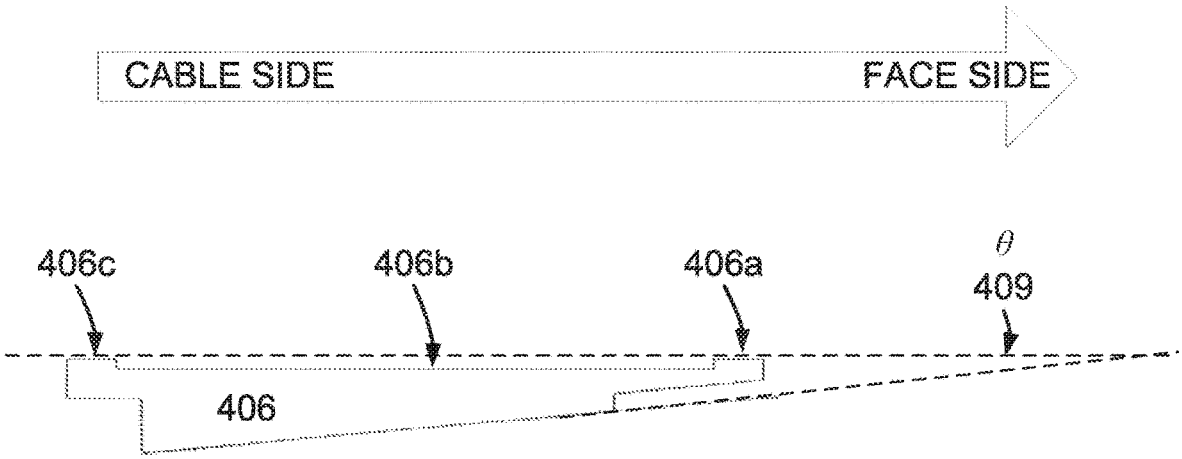
FIG. 4C is a simplified cross-sectional illustration of a portion of a support component of the electric connector of FIG. 4A.

Reference is now made to FIG. 4C, which is a simplified cross-sectional illustration of a portion of a support component 406 of the electric connector of FIG. 4A.

FIG. 4C depicts the three portions of the support 406—the face side portion 406*a*, the mid-portion 406*b*, and the cable side portion 406*c*. The face side portion 406*a* and the cable side portion 406*c* protrude from the support 406, and can potentially act as fulcrums for the support 406 to potentially flex under pressure, and potentially provide the force $F_k$ 324 depicted in FIG. 3C.

FIG. 4C also depicts the angle θ 409 of an internal surface of the support 406 relative to a cable-to-face direction of the support 406.

Figure 4D:
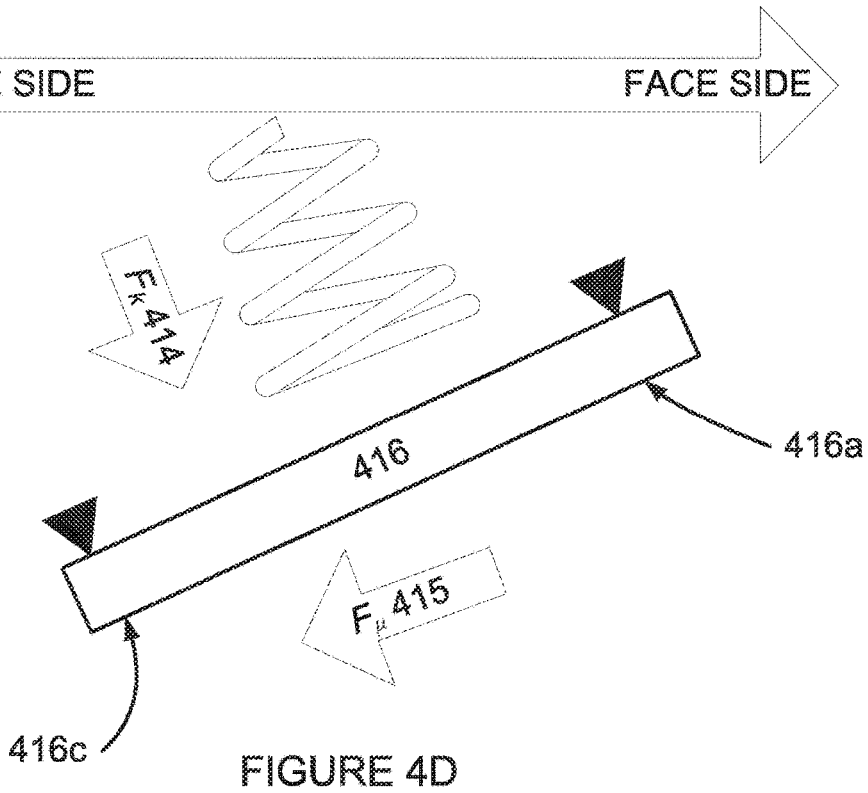
FIG. 4D is a simplified illustration of a support component of an electric connector constructed according to an example embodiment of the invention.

Reference is now made to FIG. 4D, which is a simplified illustration of a support 416 component of an electric connector constructed according to an example embodiment of the invention.

FIG. 4D depicts how the support 416 may provide a force $F_k$ 414 similar to the force $F_k$ 324 of FIG. 3C, based on the support 416 being flexible and being supported at its ends 416*a* and 416*c*.

FIG. 4D also depicts how the support 416 may provide a friction force $F_\mu$ 415 similar to the friction force $F_k$ 325 of FIG. 3C.

Figure 4E:
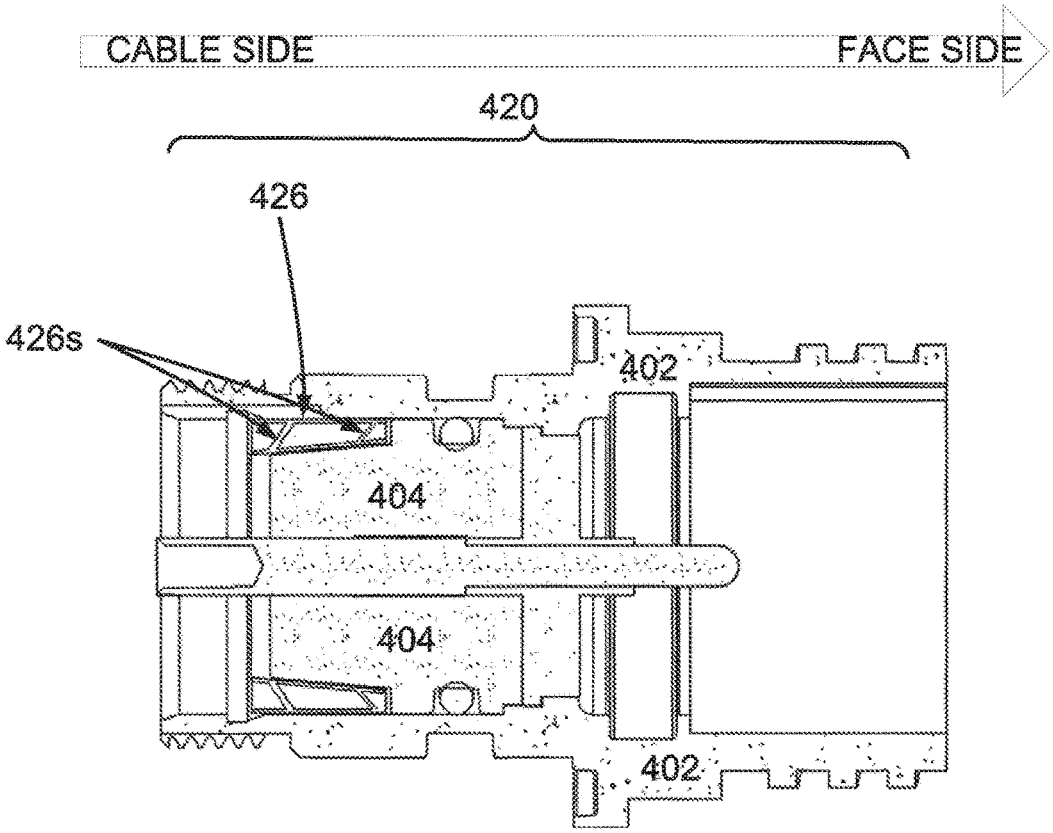
FIG. 4E is a simplified cross-sectional illustration of an electric connector according to an example embodiment of the invention.

Reference is now made to FIG. 4E, which is a simplified cross-sectional illustration of an electric connector 420 according to an example embodiment of the invention.

FIG. 4E depicts a cross-sectional view of the electric connector 420, including a shell 402; an insert 404; and a support 426.

Attention is drawn to the support 426, which in the example embodiment depicted in FIG. 4E has one or more spring(s) 426*s* between an outer surface of the support 426 designed to lie against an inner surface of the connector shell 402, and an inner surface of the support 426 designed to lie against an outer surface of the insert 404.

Figure 4F:
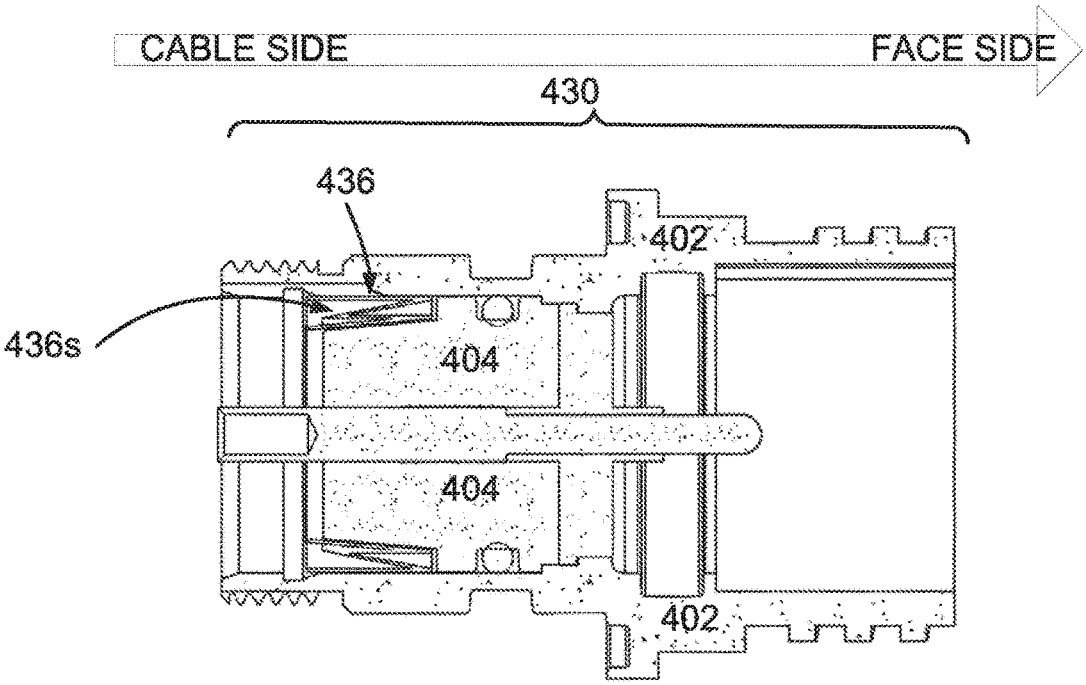
FIG. 4F is a simplified cross-sectional illustration of an electric connector according to an example embodiment of the invention.

Reference is now made to FIG. 4F, which is a simplified cross-sectional illustration of an electric connector 430 according to an example embodiment of the invention.

FIG. 4F depicts a cross-sectional view of the electric connector 430, including a shell 402; an insert 404; and a support 436.

Attention is drawn to the support 436, which in the example embodiment depicted in FIG. 4F has a one or more V-shaped spring(s) 436*s* between an outer surface of the support 436 designed to lie against an inner surface of the connector shell 402, and an inner surface of the support 436 designed to lie against an outer surface of the insert 404.

Figure 5:
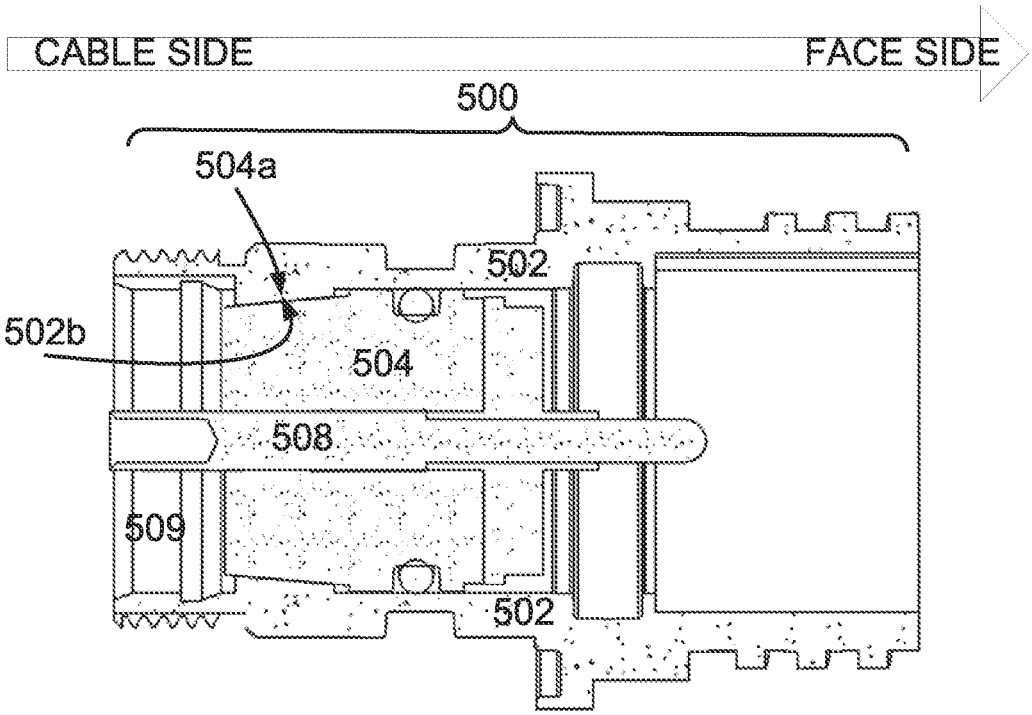
FIG. 5 is a simplified cross-sectional illustration of an electric connector according to an example embodiment of the invention.

Reference is now made to FIG. 5, which is a simplified cross-sectional illustration of an electric connector 500 according to an example embodiment of the invention.

FIG. 5 depicts a cross-sectional view of the electric connector 500, including a shell 502; an insert 504. It is noted that the insert 504 has an outer surface 504*a* designed to lie against an inner surface of the connector shell 502*b*, optionally at the angle θ mentioned above, and that the shell 502 has at least a portion of an inner surface at the angle θ mentioned above.

The example embodiment depicted in FIG. 5 may optionally benefit from the design described herein without using the insert described with reference to some previous example embodiments.

In some embodiments the example embodiment depicted in FIG. 5 may still, in addition to having at least a portion of an inner surface at the angle θ mentioned above, include an insert (not shown) between the shell 502 and the insert 504, and the insert may optionally be a springy insert. In some embodiments, the insert is made or partially made from one or more elastic materials.

FIG. 5 also depicts an optional retainer 509, and one or more conductor(s) 508.

Figure 6A:
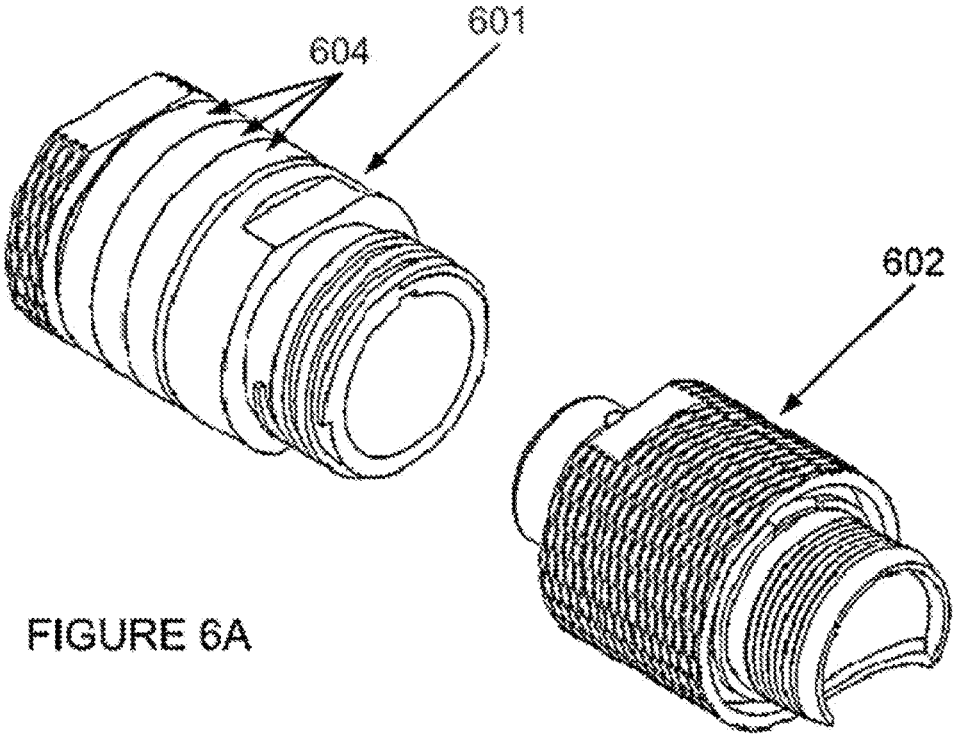
FIGS. 6A and 6B are an isometric view and a cross-sectional isometric view of an example embodiment of the invention, respectively.
Figure 6B:
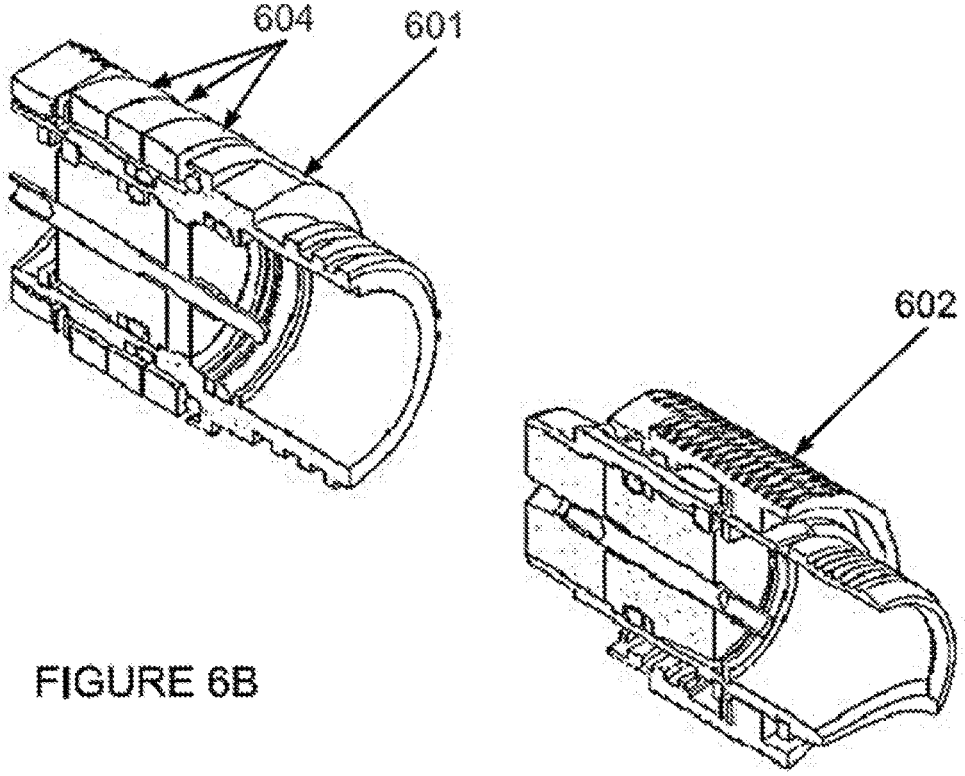

Reference is now made to FIGS. 6A and 6B, which are an isometric view and a cross-sectional isometric view of an example embodiment of the invention, respectively.

FIGS. 6A and 6B depict an example embodiment of a female connector 602 for mating with a male connector 601.

The male connector 601 also has three optional spacer rings 604*a,b,c*, which can potentially space a connector to overcome thin walls that would otherwise prevent a nut from clamping down the connector 601 as there would be a gap between the nut and an internal surface of the wall.

Figure 6C:
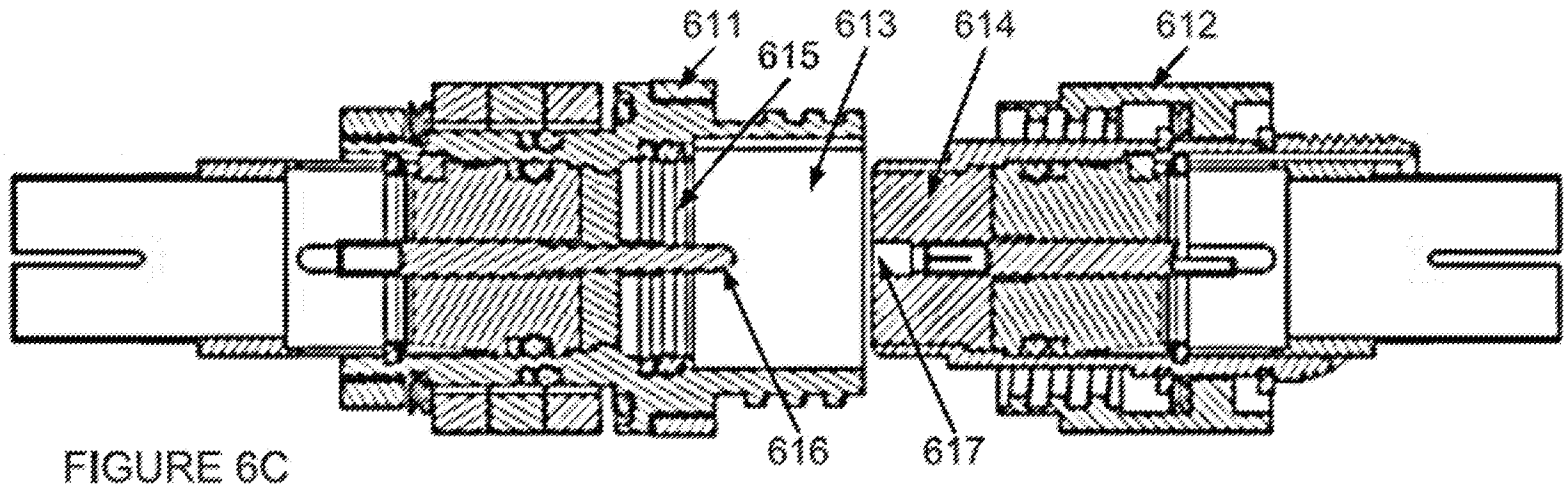
FIGS. 6C and 6D are cross-sectional views of an electric connector constructed according to an example embodiment of the invention.
Figure 6D:
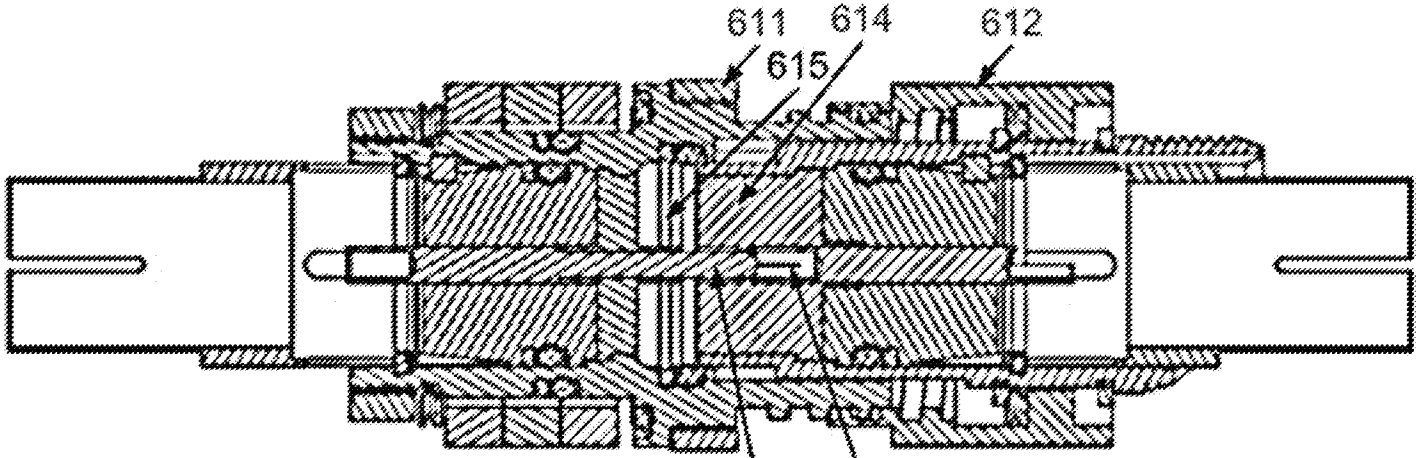

Reference is now made to FIGS. 6C and 6D, which are cross-sectional views of an electric connector constructed according to an example embodiment of the invention.

FIG. 6C shows two corresponding connectors 611 612 before being connected (FIG. 6C) and at a point of being partially connected (FIG. 6D). What was an empty space 613 in the male connector 611 before connection, is now taken up by a gasket 614 of the female connector 612, potentially displacing water, fluids, dirt and so on from the connection. A protruded portion of a face gasket 615 on the connector 611 wraps a base of a male contact 616, and when the connectors 611 612 are interfaced the protrusion sites within a matching recess 617 in the gasket 614 of the female connector 612. The recess 617 is such that when the gaskets 614 615 from the connectors 611 612 interface any fluid or dirt present are either pushed out or isolated from the mated contact pair, preventing shortage between otherwise insulated contacts. Such a design potentially enables wet mating of the connectors 611 612.

Figure 7A:
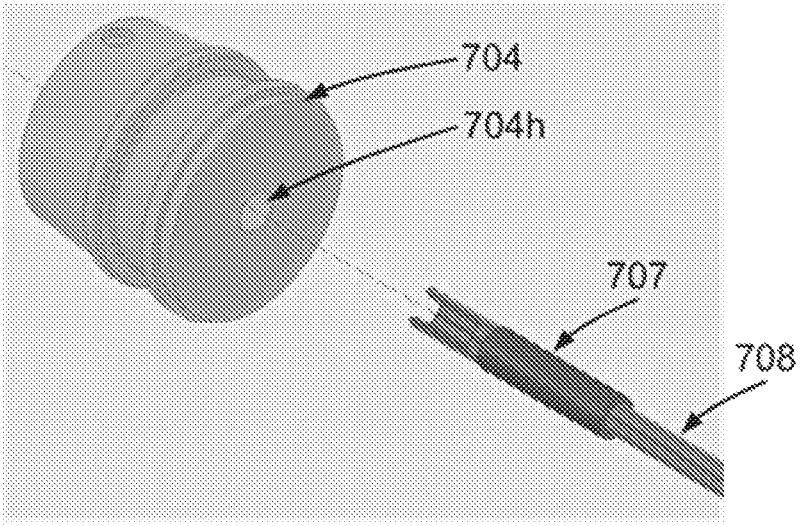
FIGS. 7A and 7B are an isometric view and a cross-sectional isometric view of an example embodiment of the invention, respectively.
Figure 7B:
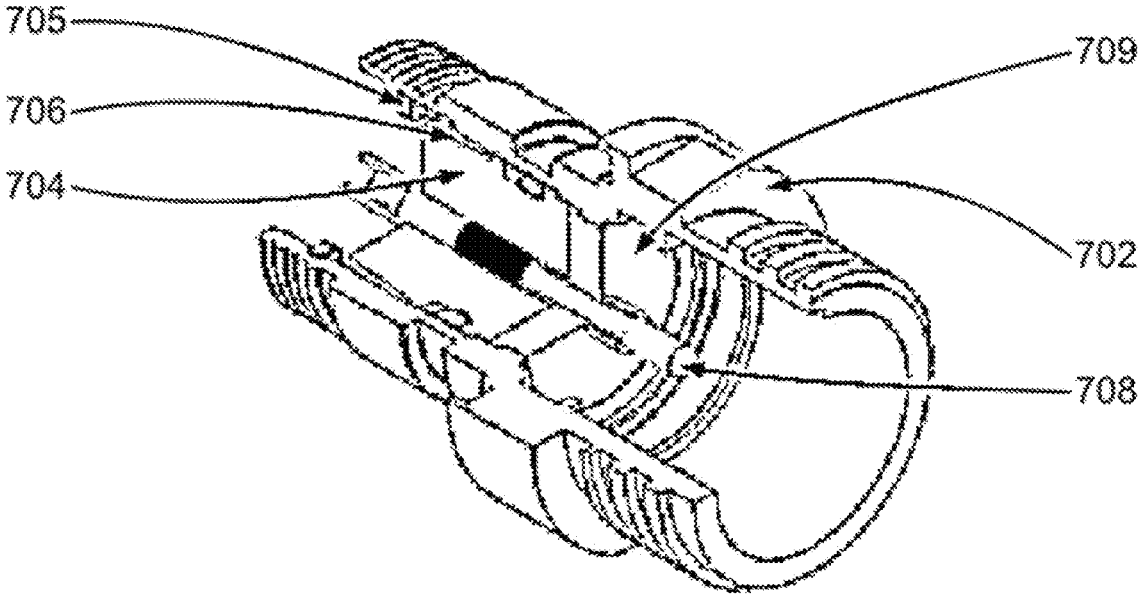

Reference is now made to FIGS. 7A and 7B, which are an isometric view and a cross-sectional isometric view of an example embodiment of the invention, respectively.

FIG. 7A depicts a conductor 708 and an insert 704 in an exploded view, so that it may be seen that the insert 704 is optionally shaped with a hole 704*h* sized to seal around the conductor 708, potentially preventing water and/or dirt access to a portion of the conductor 708 which is within the insert 704, and/or onward to an inside of a cable (not shown). In some embodiments a portion 707 of the conductor 708 is optionally provided with a rough outer surface, so as to produce high friction resistance to the conductor 708 slipping out of an insert 704 when the conductor 708 is within the insert 704.

FIG. 7B depicts the conductor 708 and the sealing gasket 709 assembled within a connector shell 702. FIG. 7B also depicts an insert 704, a support 706 and an optional retainer 705, corresponding to the optional retainer 228 of FIG. 2.

A Design Suitable for Assembly from a Cable Side of the Connector

An aspect of some embodiments of the present invention includes providing a method for assembling an insert and a support into a connector shell from a cable side of the connector shell.

Figure 8A:
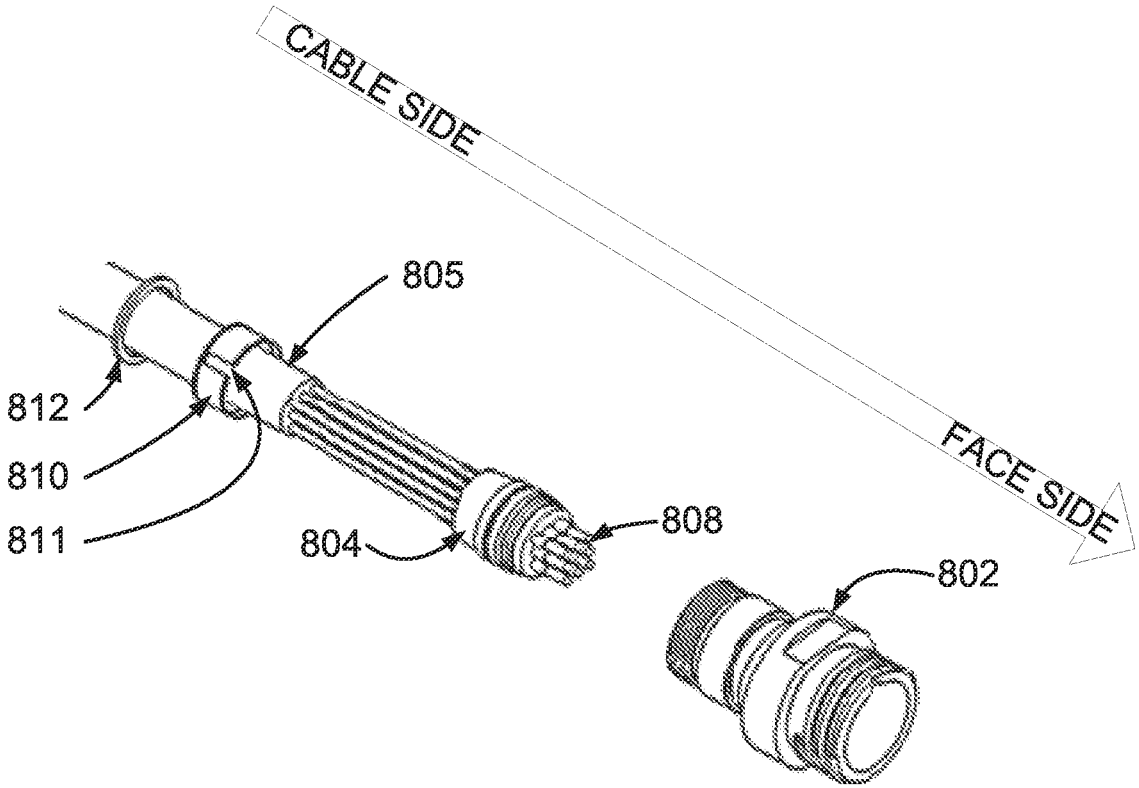
FIGS. 8A-C are simplified illustrations of components of an electric connector in a process of assembly according to an example embodiment of the invention.
Figure 8B:
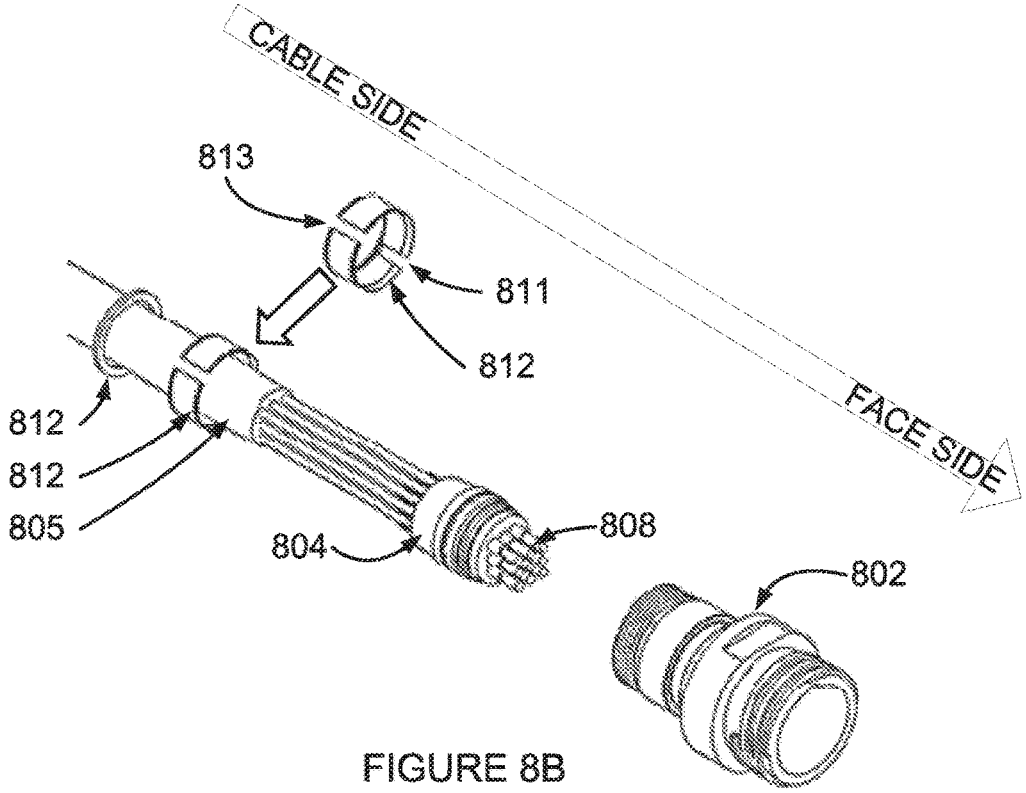
Figure 8C:
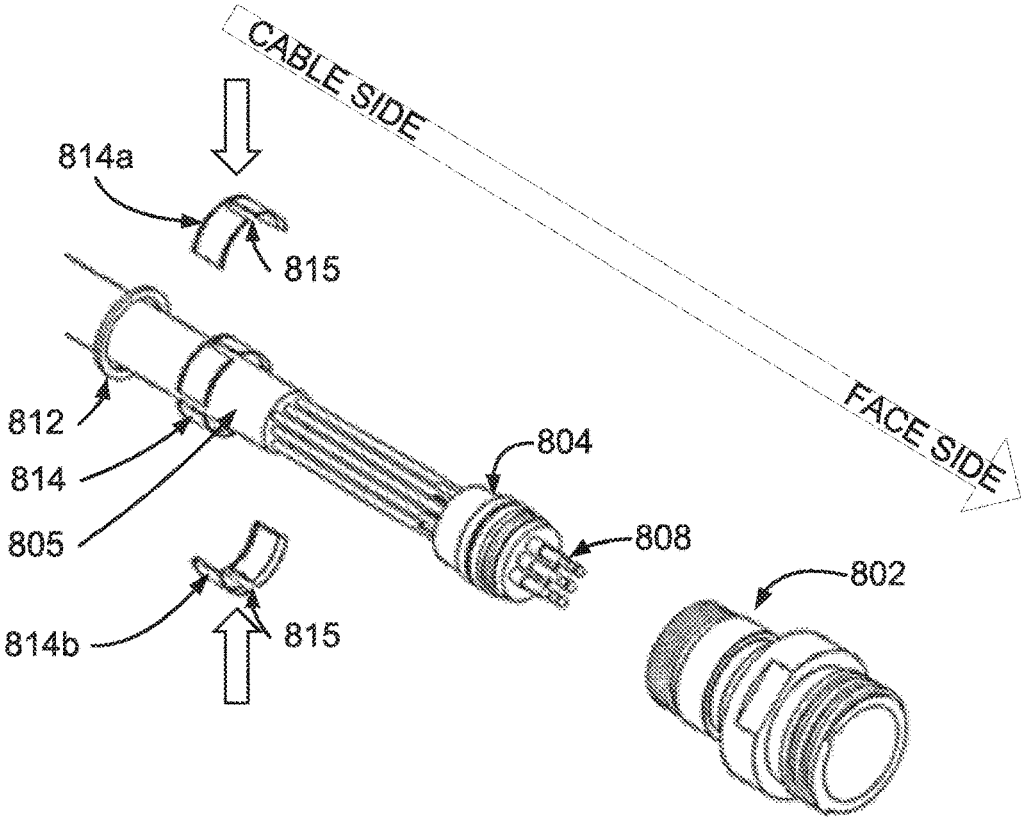

Reference is now made to FIGS. 8A-C, which are simplified illustrations of components of an electric connector in a process of assembly according to an example embodiment of the invention.

FIG. 8A depicts a cable 805 and conductors 808 already inserted through an insert 804. FIG. 8A also shows an optional retainer 812 and a support 810 mounted onto the cable 805.

It is noted that in some embodiments the insert 804 has at least a portion which is wider than the support 810, and the optional retainer 812 has at least a portion which is narrower than the support 810. When inserting conductors 808 through the insert 804, the optional retainer 812 is mounted first onto an end of the cable 805, and the support 810 is then mounted onto the end of the cable 805.

In the embodiment depicted by FIG. 8A, the support 810 has optional slots 811, extending partially through the support 812, optionally to provide additional flexibility to the support 810. Such slots are not necessary in an embodiment such as depicted in FIG. 8A.

The number of contacts in FIGS. 8A-C is nine, but as also mentioned elsewhere herein, the number of connectors may be any number.

Assembling in the above order enables assembly of a cable-and-electric-connector from a cable, or back, side of a connector shell 802. Assembly from the back side provides potential advantages as described below.

Assembling from the front requires separation of the cable and wires from the electrical components down the line, as they will most likely not fit through the shell. After passing the cable portion through the shell all electrical clients would need to be attached on the far end. Such a job is often difficult to do 'in the field', where working conditions may be dirty or cramped. Inserting the conductors into an insert is best done in better working conditions, and final assembly of the insert to the connector shell may be done 'in the field'. In some cases, a connector shell is already attached to a bulkhead, and assembling a cable, for example to replace a faulty cable, is very difficult to do. For example assembling a cable to a connector shell on a wall or bulkhead may require working in very cramped conditions, and it is better to enable termination of conductors to the contacts in the insert away from the conductor shell.

Furthermore, it is useful to assemble the conductor(s)-plus-insert combination from a back side, or cable side of the connector. Assembly from the face, or front, side would require that an entire length of the conductors be passed through the shell before inserting the insert into the connector.

When back side assembly is possible, a cable can be terminated on both ends to inserts and can then have each end assembled into its respective shell, regardless of the other end and whether or not the shells are mounted to a wall or interfaced with another cable. back side assembly also potentially enables off-site termination of a cable to the inserts.

FIG. 8B depicts the cable 805 and conductors 808 already inserted through the insert 804, the optional retainer 812 and a support 812 threaded onto the cable 805.

In the embodiment depicted by FIG. 8B, a second instance of the support 812 is also depicted not threaded on the cable 805, so that it may be seen that the support 812 has a slot 813 which enables opening the support somewhat and slipping the support 812 onto a cable even after the conductors 808 have been inserted into the insert 804.

FIG. 8B also depicts an optional additional partial slot 811, extending partially through the support 812.

FIG. 8C depicts the cable 805 and conductors 808 already inserted through the insert 804, the optional retainer 812 and a support 814 threaded onto the cable 805.

In the embodiment depicted by FIG. 8C, a second instance of the support 814 is also depicted not threaded on the cable 805, as two part 814*a* and 814*b* of the support 814, so that it may be seen that the support 814 is assembled of the two parts 814*a* 814*b* which enables assembling the support 814 onto a cable even after the conductors 808 have been inserted into the insert 804.

FIG. 8C also depicts optional additional partial slots 815, extending partially through the supports 814*a* 814*b*.

Figure 8D:
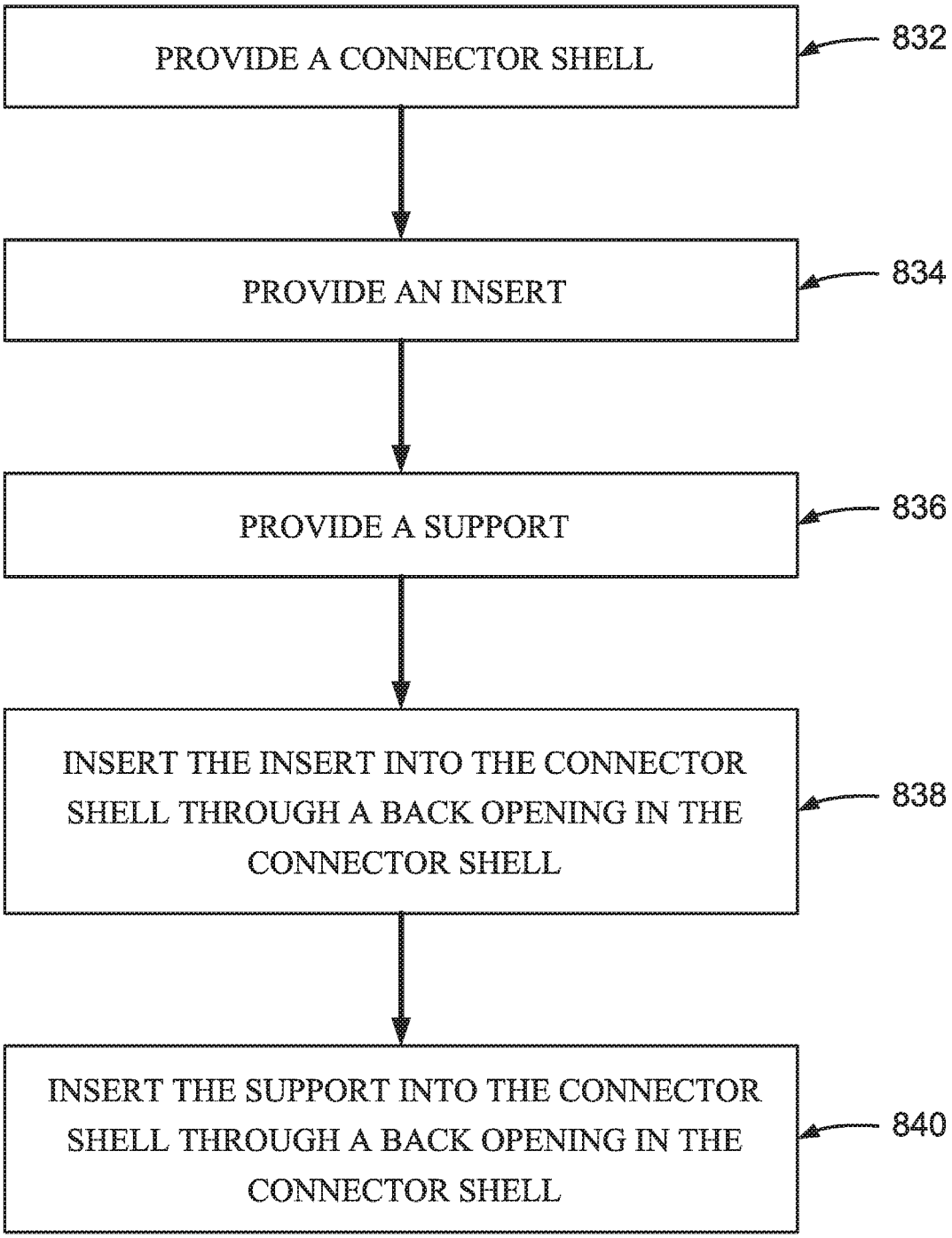
FIG. 8D is a simplified flow chart illustration of a method of manufacturing an electric connector according to an example embodiment of the invention.

Reference is now made to FIG. 8D, which is a simplified flow chart illustration of a method of manufacturing an electric connector according to an example embodiment of the invention.

The method of FIG. 8D includes:

providing a connector shell (832);

providing an insert (834);

providing a support (836);

inserting the insert into the connector shell through a back opening in the connector shell (838); and inserting the support into the connector shell through a back opening in the connector shell (840).

Figure 9A:
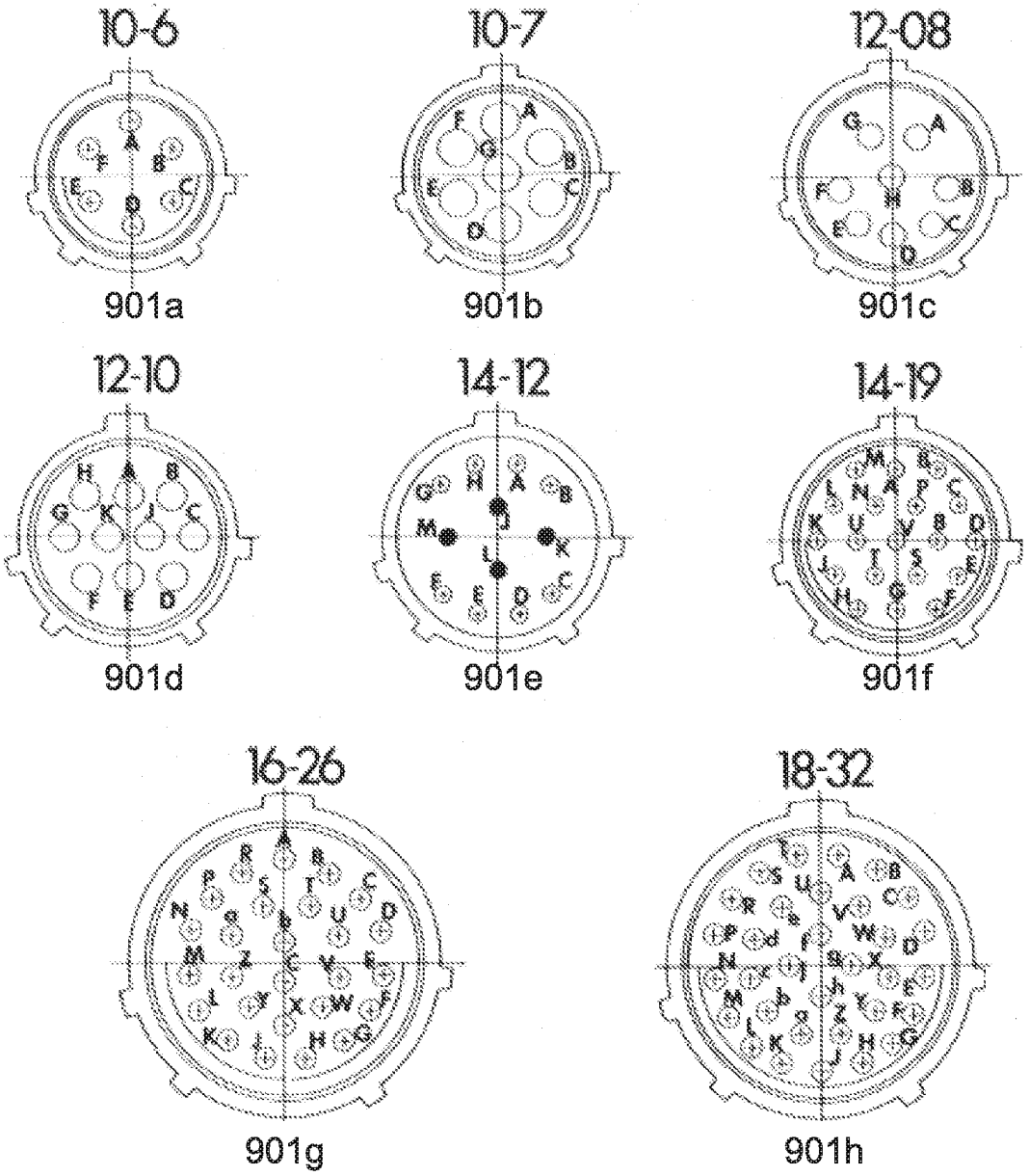
FIG. 9A is a simplified illustration of example embodiments of conductor arrangements compatible with an example embodiment of the invention.

Reference is now made to FIG. 9A, which is a simplified illustration of example embodiments of conductor arrangements 901*a-h* compatible with an example embodiment of the invention.

FIG. 9A depicts various conductor arrangements 901*a-h*, each of which may include a different number of conductors and/or a different geometric arrangement of the conductors.

It is noted that an electric connector constructed according to example embodiments of the invention may enable use of various arrangements 901*a-h* as well as other arrangements as are known in the art.

In some embodiments, the connector shell and support are designed to accept inserts with a compatible outer surface inclined to correspond to the support, while enabling various conductor arrangements 901*a-h*.

An aspect of some embodiments of the present invention includes providing a kit including an insert and a support for assembling into a connector shell to produce an electric connector according to an example embodiment of the invention.

Non-Electric Connector

It is noted that within a connector constructed according to an example embodiment of the invention may be inserted non-electric or not-fully-electric connectors.

Some non-limiting examples include an optic-fiber to optic-fiber connector, and an optic-fiber to electric converter.

Figure 9B:
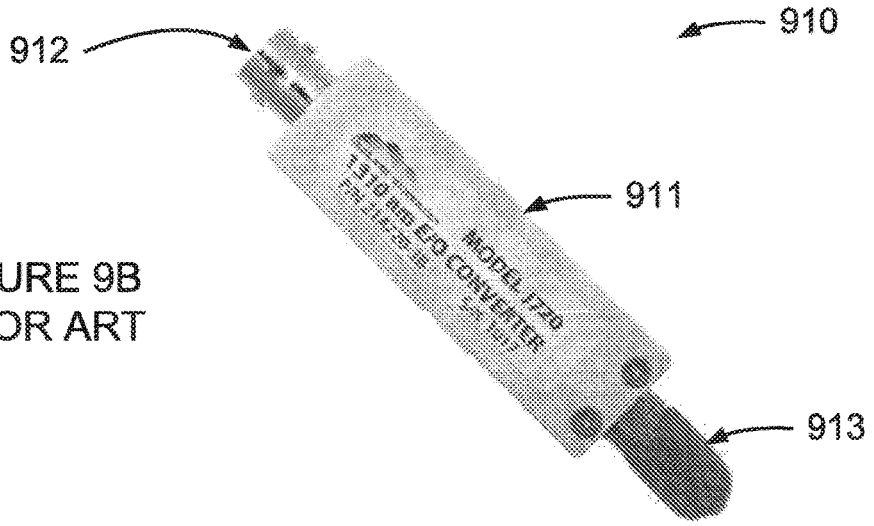
FIGURE 9B PRIOR ART
FIG. 9B is an image of a prior art off-the-shelf an optical fiber to electric signal converter.

Reference is now made to FIG. 9B, which is an image of a prior art off-the-shelf an optical fiber to electric signal converter.

Figure 9C:
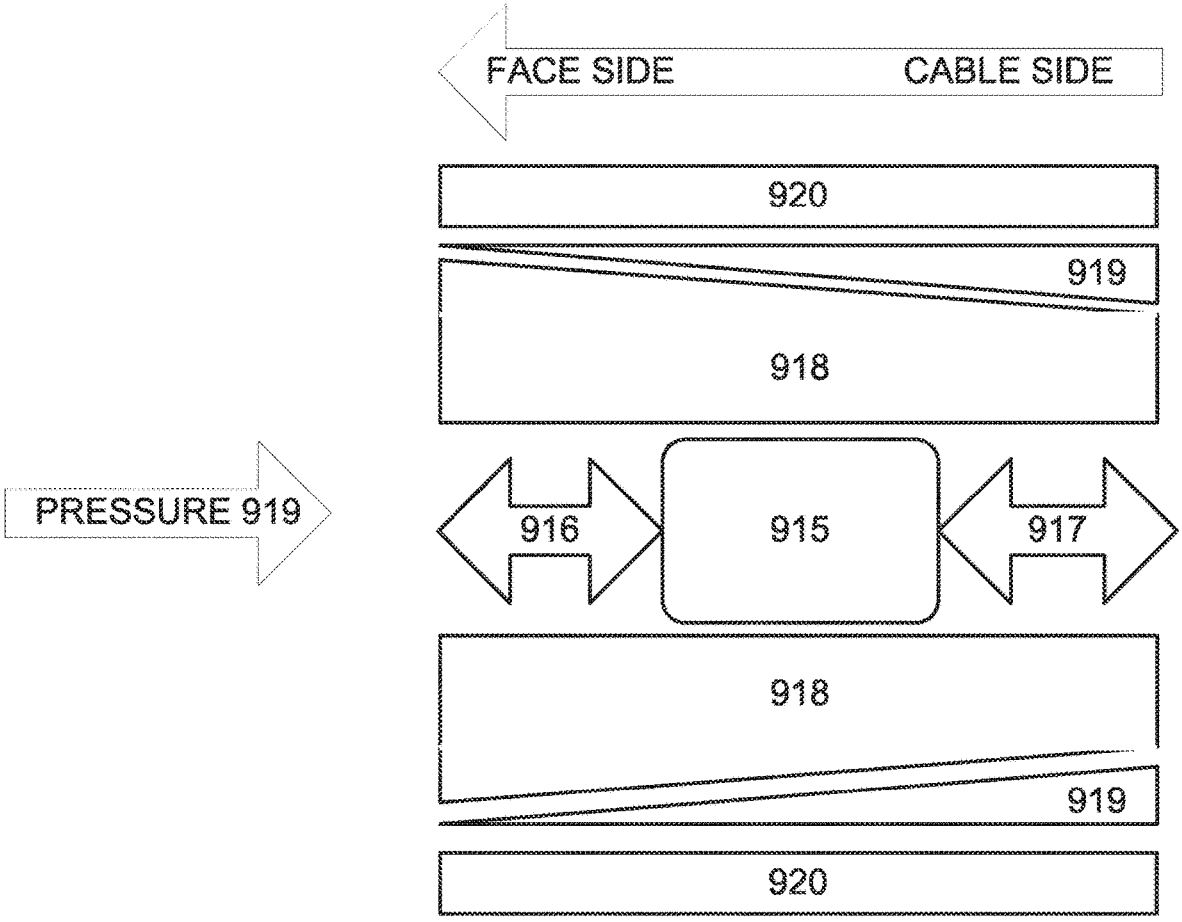
FIG. 9C is a simplified illustration of a different arrangement according to an example embodiment of the invention.

Reference is additionally made to FIG. 9C, which is a simplified illustration of a different arrangement according to an example embodiment of the invention.

FIG. 9B depicts a specific example of an optical fiber to electric signal converter, and FIG. 9C depicts a generic block diagram describing such a converter/connector.

FIG. 9B depicts an example converter 910 which includes a converter enclosure 911, an electric connection 912, and an optic connection 913. Such a converter 910 easily fits within an insert of a connector constructed according to an example embodiment of the invention.

FIG. 9C depicts a block diagram illustration of a cross section of an insert 918, within which is depicted a block diagram illustration of an optic fiber to electric signal converter 915, having an electric conductor 916 at a face side, and an optic fiber conductor 917 at a cable side. The insert 918 has an outer surface with the angle θ described herein, within a support 919 with a surface with a corresponding angle, and within a connector shell 920.

In some embodiments an optic fiber is attached to the optic fiber connector before inserting the converter 915 into the insert 918.

Figure 10A:
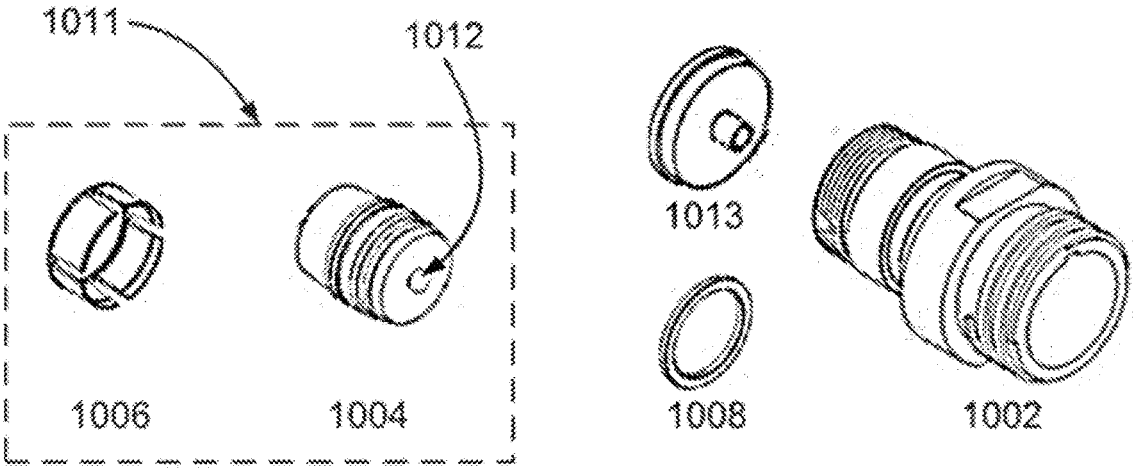
FIGS. 10A and 10B are simplified illustrations of kits of components of an electric connector according to an example embodiment of the invention.
Figure 10B:
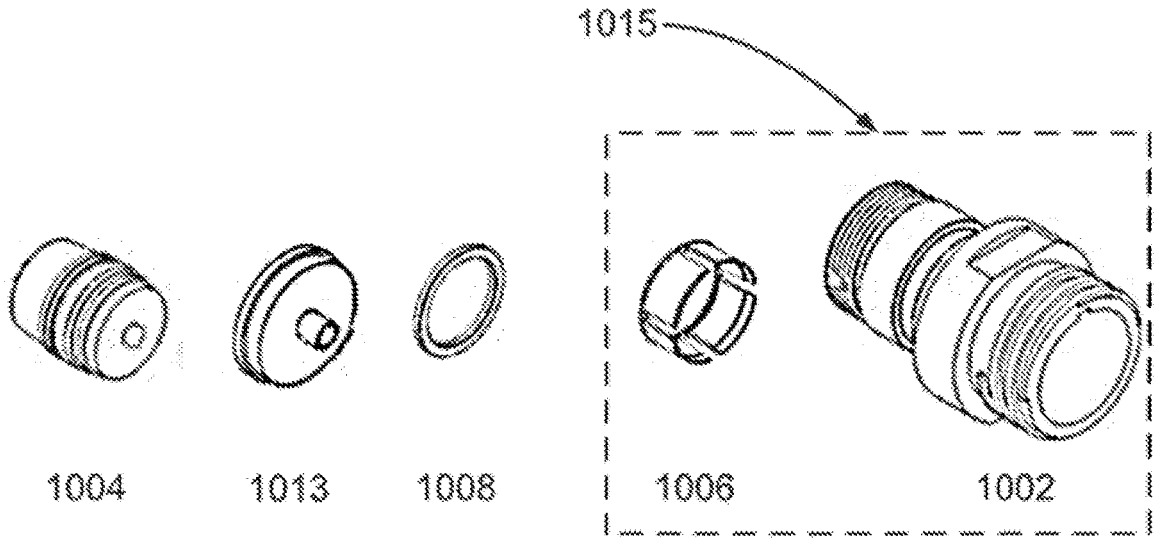

Reference is now made to FIGS. 10A and 10B, which are simplified illustrations of kits of components of an electric connector according to an example embodiment of the invention.

One example embodiment of a kit 1011 may include an insert 1004 and an associated support 1006. An inside surface of the support 1006 and an outside surface of the insert 1004 are shaped with the angle θ described above with reference to FIG. 3C. The insert 1004 may or may not have one or more holes 1012 through it for inserting conductors, or a buyer of the kit may optionally prepare the holes.

The kit 1011 may optionally be augmented by a retainer 1008, in any one of the shapes described herein with reference to FIG. 2 and FIGS. 8A-C.

The kit 1011 may optionally be augmented by a gasket 1013, for example such as the sealing gasket 231 of FIG. 2.

The kit 1011 may optionally be augmented with a connector shell 1002 having an inner surface shaped and sized to support an outer surface of the support 1006, as described herein.

One example embodiment of a kit 1015 may include a support 1006 and a connector shell 1002 having an inner surface shaped and sized to support an outer surface of the support 1006, as described herein. An inside surface of the support 1006 is shaped with the angle θ described above with reference to FIG. 3C.

The kit 1015 is ready for an insert 1004 which has an outside surface shaped with the angle θ described above with reference to FIG. 3C. A manufacturer may purchase inserts 1004 and associated kits 1015 with corresponding angles and diameters, add cables, and produce cables with electric connectors designed according to an example embodiment of the invention.

The kit 1015 may optionally be augmented by a retainer 1008, in any one of the shapes described herein with reference to FIG. 2 and FIGS. 8A-C.

The kit 1015 may optionally be augmented by a gasket 1013, for example such as the sealing gasket 231 of FIG. 2.

Figure 11:
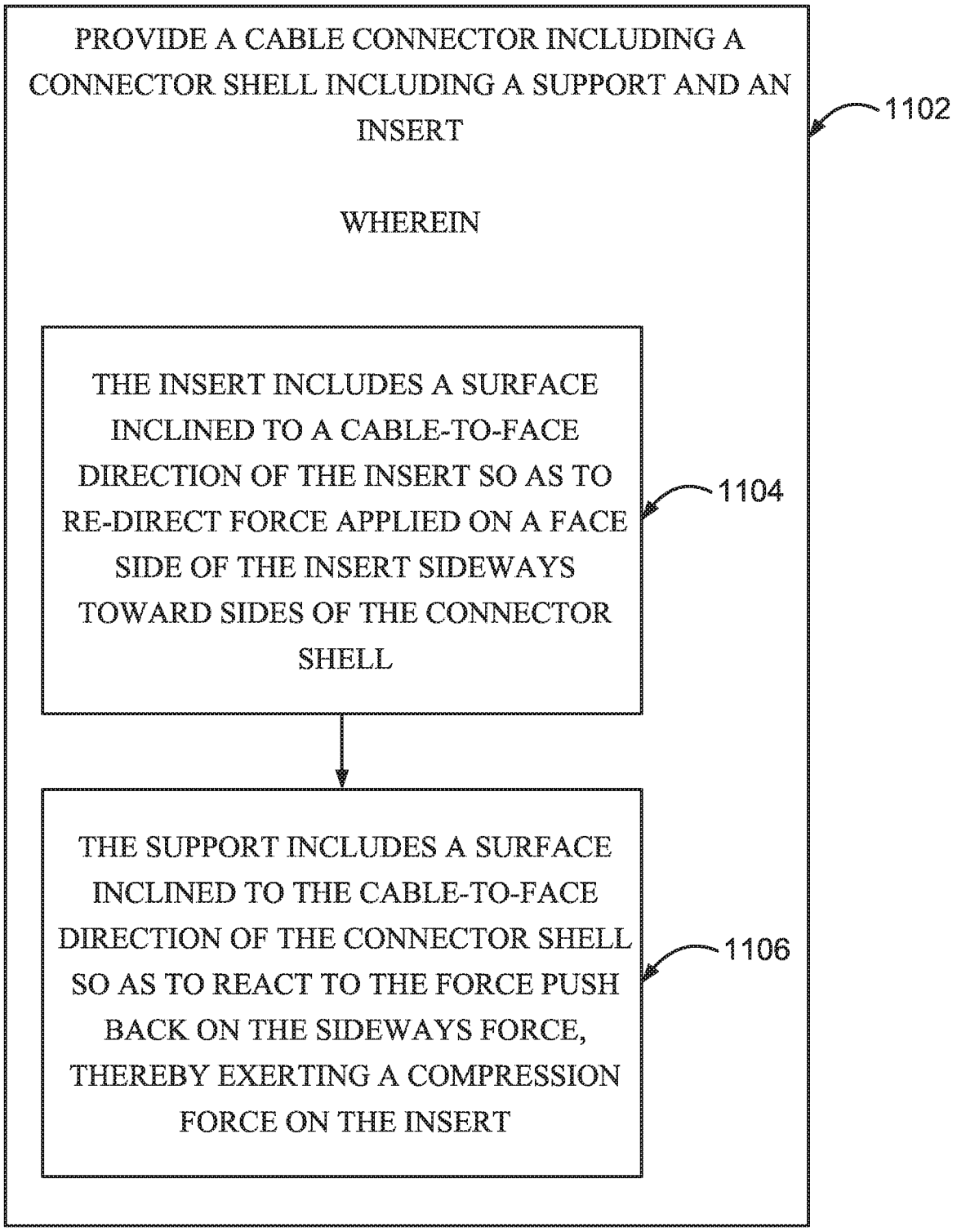
FIG. 11 is a simplified flow chart illustration of a method of providing a connector for withstanding high pressure according to an example embodiment of the invention.

Reference is now made to FIG. 11, which is a simplified flow chart illustration of a method of providing a connector for withstanding high pressure according to an example embodiment of the invention.

The method of FIG. 11 includes:

providing a cable connector including a connector shell including a support and an insert (1102), wherein the insert includes a surface inclined to a cable-to-face direction of the insert so as to re-direct force applied on a face side of the insert sideways toward sides of the connector shell (1104); and the support includes a surface inclined to the cable-to-face direction of the connector shell so as to react to the force push back on the sideways force, thereby exerting a compression force on the insert (1106).

It is expected that during the life of a patent maturing from this application many relevant connector shells, retainer, conductors, and conductor geometric arrangements will be developed and the scope of the terms connector shell, retainer, conductor and conductor geometric arrangement are intended to include all such new technologies a priori.

As used herein the terms "about", "approximately" and "≈" refer to ±20%.

The terms "comprising", "including", "having" and their conjugates mean "including but not limited to".

The term "consisting of" is intended to mean "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a unit" or "at least one unit" may include a plurality of units, including combinations thereof.

The words "example" and "exemplary" are used herein to mean "serving as an example, instance or illustration". Any embodiment described as an "example or "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A cable connector comprising a connector shell including a support and an insert, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert, wherein said support is a springy support, wherein the support is a separate component from the connector shell, and wherein an outer diameter of the insert and an outer diameter of the support are sized so as to pass through a back opening in the connector shell, to enable assembly of the connector by inserting the insert and the support through the back opening in the connector shell.

2. The cable connector of claim 1, wherein:

the insert comprises a surface inclined at an angle θ to a cable-to-face direction of the insert; and the support comprises a first, inner, surface inclined at a same angle θ to the cable-to-face direction of the insert, such that when the insert is within the support the inclined surface of the insert and the first, inner, inclined surface of the support are adjacent to each other.

3. The connector of claim 1, wherein the support further comprises a second, outer surface at an angle parallel to an inner surface of the connector shell, such that when the support is within the connector shell the second, outer, surface of the support is adjacent to an inner surface of the connector shell.

4. The connector of claim 1, in which the insert comprises an inner passage shaped for containing an electric conductor, wherein the inner passage is sized and shaped to seal the inner passage when the electric conductor is contained within the passage.

5. The connector of claim 1, and further comprising a sealing gasket on a front face of the connector, the sealing gasket comprising a protruding portion for wrapping a portion of a protruding electric contact.

6. The connector of claim 1, and further comprising a sealing gasket on a front face of the connector, the sealing gasket comprising a recess for accepting a protruding portion of a gasket when mated to a mating connector.

7. The connector of claim 1, in which the insert comprises an inner passage shaped for containing an optic signal to electric signal converter, wherein the inner passage is sized and shaped to conform to an external shape of the converter.

8. A cable connector comprising a connector shell including a support and an insert, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert, wherein said support is a springy support, in which the support comprises a plurality of rings with an outer diameter equal to an inner diameter of the connector shell.

9. The connector of claim 8, in which the support comprises a span between the rings with an outer diameter smaller than an inner diameter of the connector shell.

10. The connector of claim 1, in which the support comprises a spring.

11. The connector of claim 1, in which the support comprises one or more elastic materials.

12. A cable connector comprising a connector shell including a support and an insert, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert, wherein said support is a springy support, wherein:

the insert comprises a surface inclined at an angle θ to a cable-to-face direction of the insert; and the support comprises a first, inner, surface inclined at a same angle θ to the cable-to-face direction of the insert, such that when the insert is within the support the inclined surface of the insert and the first, inner, inclined surface of the support are adjacent to each other, in which the support comprises a slot in an axial direction, from a front edge of the support toward a back edge of the support.

13. The connector of claim 12, in which the support comprises a plurality of slots.

14. A cable connector comprising a connector shell including a support and an insert, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert, wherein said support is a springy support, wherein:

the insert comprises a surface inclined at an angle θ to a cable-to-face direction of the insert; and the support comprises a first, inner, surface inclined at a same angle θ to the cable-to-face direction of the insert, such that when the insert is within the support the inclined surface of the insert and the first, inner, inclined surface of the support are adjacent to each other, in which the support comprises a plurality of sections shaped to fit together and make up the support.

15. The connector of claim 2, in which the support comprises two sections shaped to fit together and make up the support.

16. A cable connector comprising a connector shell including a support and an insert, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert, wherein said support is a springy support, and further comprising a retainer shaped to attach to a back edge of the connector shell, preventing the support and the insert from exiting the back of the connector shell, wherein:

the insert comprises a surface inclined at an angle θ to a cable-to-face direction of the insert; and the support comprises a first, inner, surface inclined at a same angle θ to the cable-to-face direction of the insert, such that when the insert is within the support the inclined surface of the insert and the first, inner, inclined surface of the support are adjacent to each other.

17. The connector of claim 2, in which the support is shaped to attach to a back edge of the connector shell, preventing the insert from exiting the back of the connector shell.

18. A method of manufacturing a connector comprising:

providing a connector shell;

providing an insert;

providing a springy support;

inserting the insert into the connector shell through a back opening in the connector shell; and inserting the support into the connector shell through a back opening in the connector shell, wherein:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert.

19. The method of claim 18 in which:

the insert comprises a surface inclined to a cable-to-face direction of the insert so as to re-direct force applied on a face side of the insert sideways toward sides of the connector shell; and the support comprises a surface inclined to the cable-to-face direction of the connector shell so as to react to the force, pushing back on the insert, thereby exerting a compression force on the insert.

* * * * *